United States Patent [19]

Inoue et al.

[11] 4,042,388

[45] Aug. 16, 1977

[54] PROCESS FOR THE PREPARATION OF SENSITIZED MATERIAL FOR ELECTROPHOTOGRAPHY

[75] Inventors: Eiichi Inoue; Ichiro Endo, both of Tokyo; Teruo Yamanouchi, Fujisawa, all of Japan

[73] Assignee: Canon Kabushiki Kaisha, Tokyo, Japan

[21] Appl. No.: 347,075

[22] Filed: Apr. 2, 1973

Related U.S. Application Data

[63] Continuation of Ser. No. 234,988, March 15, 1972, abandoned, which is a continuation of Ser. No. 858,539, Sept. 16, 1969, abandoned.

[51] Int. Cl.[2] ..... G03G 5/06

[52] U.S. Cl. ..... 96/1.6

[58] Field of Search ..... 96/1.5, 1.6, 90 R; 252/501

[56] References Cited

U.S. PATENT DOCUMENTS

| | | | |
|---|---|---|---|
| 3,102,029 | 8/1963 | Fichter et al. | 96/90 R |
| 3,102,810 | 9/1963 | Sprague et al. | 96/90 R X |
| 3,113,022 | 12/1963 | Cassiers et al. | 96/1.5 |
| 3,287,120 | 11/1966 | Hoegl | 96/1.5 |
| 3,421,891 | 1/1969 | Inami et al. | 96/1.5 |
| 3,434,833 | 3/1969 | Fox | 96/1.5 |
| 3,458,310 | 7/1969 | Arneth et al. | 96/1.6 |
| 3,502,476 | 3/1970 | Itano et al. | 96/90 R |
| 3,512,966 | 5/1970 | Shattuck et al. | 96/1.5 |
| 3,525,612 | 8/1970 | Holstead | 96/1 R |

*Primary Examiner*—Roland E. Martin, Jr.
*Attorney, Agent, or Firm*—Watson, Leavenworth, Kelton & Taggart

[57] ABSTRACT

The photosensitivity of organic photoconductive materials can be improved by reactively mixing a free radical former having a free radical produced by irradiation of a dye base compound and an organic photoconductive materials with radiation energy.

7 Claims, No Drawings

PROCESS FOR THE PREPARATION OF SENSITIZED MATERIAL FOR ELECTROPHOTOGRAPHY

This is a continuation, of application Ser. No. 234,988, filed March 15, 1972, which is a continuation of Ser. No. 858,539 filed Sept. 16, 1969, now abandoned This invention relates to a process for sensitizing organic photoconductive materials by using a dye base compound and a free radical former which gives free radicals when excited with radiation energy a method for decomposing the free radical former, and highly sensitive photosensitive compositions and articles of manufacture for electrostatic photography obtained by said process.

Photosensitive materials previously used for electrostatic photography consisted of metallic selenium and a selenium alloy for indirect electrostatic photography and metal oxides such as zinc oxide for direct electrostatic photography.

Photosensitive materials for electrostatic photography comprising organic photoconductive materials are far superior in transparency, flexibility, light weight, film-shapability, selectivity of charged polarity, smoothness of surface, etc, as compared with selenium and zinc oxide. However, in spite of such advantages, organic photoconductive materials have not been widely used since the photosensitivity of organic photoconductive materials is remarkably low as compared with selenium and zinc oxide, and a strong light soruce is necessary for imagewise exposure after charged.

Various organic photoconductive materials are known. Some of those organic photoconductive materials are, for example, condensed polycyclic aromatic compounds such as anthracene, pyrene, perylene and the like; heterocyclic compounds such as triphenylpryazoline derivatives, acylhydrazone derivatives and the like; and polymers such as poly-N-vinylcarbazole and the like. However, these prior art organic photoconductive materials have disadvantageously low photosensitivity; however, some organic materials having high photosensitivity have been recently developed by synthetic chemical means.

For example, brominated poly-N-vinylcarbazole disclosed in Japanese Patent Publication No. 25230/1967, poly-3,6-diiodo-9-vinylcarbazole disclosed in Japanese Patent Publication No. 7592/1968, poly-N-vinyl-3-aminocarbazole disclosed in Japanese Patent Publication No. 9639/1967, and polyvinylanthracene disclosed in Japanese Patent Publication No. 2629/1968 have improved photosensitivity.

These organic photoconductive materials do not show practically high photosensitivity when used alone. Therefore, these photoconductive materials are usually used in combination with an appropriate spectrum sensitizing coloring materials. For example, brominated polyvinylcarbazoles are used together with a triarylcarbonium salt dye to obtain a photosensitivity as high as zinc oxide sensitized by coloring matter. However, the photosensitive characteristics of such photosensitive material of relatively high photosensitivity containing the organic photoconductive material depend upon a spectrum sensitizing coloring matter to a great extent as well as the organic photoconductive material itself, and in addition, the organic photoconductive material and the sensitizing coloring matter are prepared by a complicated synthetic method and complicated purification, and thus such high-sensitization method is not desirable from an economical and practical point of view.

The present inventors have now found that the characteristics of electrophotographic materials containing mainly organic photoconductive material can be improved especially the photosensitivity. This improvement is obtained by applying a simple sensitizing treatment to an organic photoconductive material and dye base compound to produce a photosensitive material for electrophotography having photosensitivity of the same as or higher than the degree of photosensitivity of electrostatic photographic material comprising selenium or zinc oxide especially selenium or zinc oxide sensitized by coloring matter.

The present inventors have previously found that a highly sensitive electrophotographic photosensitive material is obtained by applying radiation energy to an organic photoconductive material and a free radical former which gives free radicals when excited by radiation energy. The above-mentioned invention has been filed as U.S. Ser. No. 843,809 on July 22, 1969, and in said patent application it is disclosed that said highly sensitive electrophotographic photosensitive material is excellent from an economical and practical point of view.

According to the present invention, an organic photoconductive material, a free radical former which gives free radicals when excited with radiation energy and a dye base compound are combined and radiation energy is applied thereto to decompose the free radical former and thereby produce the highly sensitized photosensitive material.

According to the present invention, a dye base compound is added to the composition of the previous invention to obtain the following advantages:

1. The photosensitivity can be further improved;
2. The spectrum absorption characteristics of electrophotographic photosensitive materials can be controlled. Therefore, a photosensitive material suitable for reproduction of color images can be easily obtained:
3. With respect to photosensitive materials for electrostatic photography, color tone of the photosensitive material itself is an important factor in connection with the appearance and the usage. The color tone can be easily adjusted by using the dye base compound and any desired color tone can be imparted according to the usage; and
4. The surface potential of the electrophotographic photosensitive material can be increased by appropriately selecting the dye base compound and therefore, contrast of image can be improved.

Some photosensitive materials have been used for recording materials in which there are employed free radical formers producing free radicals when excited by radiation energy. An example thereof is a printing-out recording material known as free radical system in which the photosensitive material or recording material is disadvantageously instable from a practical point of view. This instability is due to the free radical former. For example, when using carbon tetrabromide, a representative polyhalogen compound, the photosensitive or recording matter contains unreacted carbon tetrabromide as an essential component in the photosensitive layer and carbon tetrabromide is volatile, instable, and poisonous. Such disadvantages reduce the practicability of the photosensitive or recording material the free radical exciting type. A photosensitive plate for electrophotography having a photosensitive layer which comprises a photoconductive material, a photo-decomposable material and an ingredient which forms a sensitizing dye by reacting photosynthetically with the photo-decomposable material is also known. In such photosensitive plate, when an original pattern is projected onto it, the exposed portion is sensitized by the formation of a sensitizing dye as the result of photosynthesis, while in the unexposed portion any sensitizing dye is formed and the unexposed portion is not sensitized. One of such electrophotographic process is disclosed in French Pat. No. 1,483,494. However, conventional photosensitive plates of the above-mentioned type have various disadvantages as follows. The feature of the above-mentioned type of electrophotographic process resides in that a sensitizing dye is photosynthetically formed according to the original pattern on the photosensitive plate and the resulting sensitizing dye give a difference of photosensitivity between the exposed portion and the unexposed portion. Therefore, the projected light of the original pattern should have a light energy sufficient to form the sensitizing dye. In other words, the intensity of light energy should be sufficient to cause photolysis of the photo-decomposable compound which forms the sensitizing dye. Thus, radiation of short wave length having a sufficient intensity of light energy such as near ultraviolet light or light in the ultraviolet region, is used as the projected light of the original pattern. However, it is not practical to use such a high energy light source since the wave length and the energy strength of light used for imagewise exposure are, in general, extremely important factors in electrophotographic process. For example, when the wave length of the exposure light is short, the absorption by the exposure optical system is large and not desirable from a practical point of view, and further the copying apparatus becomes larger.

The photosensitive plate in which the photosensitivity is different between the exposed portion and the unexposed portion in accordance with the original pattern, is not always used for conventional electrophotographic proceses, but is effectively used only for a specified electrophotographic process. The electrophotographic system giving a difference of sensitivity between the exposed portion and the unexposed portion of the photosensitive plate according to original pattern, does not directly utilize the property of conventional photosensitive plate that when an original pattern is projected, the exposed portion becomes conductive and the unexposed portion retains insulating property. According to said electrophotographic system, the original pattern is converted to a "sensitized pattern" by the formation of a sensitizing dye at the exposed portion (the sensitized pattern is a negative pattern since the exposed portion is sensitized by the dye). The photosensitive plate thus obtained can not be employed in conventional processes comprising charging — original pattern projection — development or a modified process thereof. Said electrophotographic system can be used only for a specific and complicated electrophotographic process such that an original pattern is converted to a sensitized pattern, electrically charged, exposed uniformly so as to make relatively the decaying velocity of charge at the sensitized pattern faster than the decaying velocity of charge at the unsensitized portion (the uniform exposure should be carried out by a radiation which forms no more sensitizing material on the photosensitive plate), and then developed. Therefore, the range of usage is extremely limited. Since the sensitized pattern is directly formed on the photosensitive plate, said system can not be applied to an electrophotographic process using the photosensitive matter repeatedly since a different original pattern is projected again to form a different reproduced image by using radiation capable of producing a sensitizing dye. However, this is no problem when employing electrophotographic master and formation of a double copying image.

Furthermore, in a photosensitive plate in which the difference of sensitivity is formed between the exposed portion and the unexposed portion of the photosensitive plate in accordance with the original pattern by the formation of a sensitizing dye, a photo-decomposable compound participating in the formation of a sensitizing dye should be essentially included in the photosensitive layer when projecting the original pattern. The sensitizing dye is formed by the decomposition of the photo-decomposable compound at the exposed portion of the photosensitive layer which is a solid phase, and thereby the sensitizing effect is brought about. However, the photo-decomposable compound at the unexposed portion remains unchanged, and furthermore, undecomposed photo-decomposable compound remains even at the exposed portion to some extent. Thus, when a process comprising original pattern projection, charging, uniform exposure, and development is applied to the photosensitive plate as mentioned above, the photo-decomposable compound remains widely over the exposed portion and the unexposed portion even after the original pattern projection has been effected. This fact results in the increased natural decay of the surface potential at the charging and the lowering of electrostatic the electrostatic pattern formed by uniform exposure after charging. Accordingly an excellent image is not obtained. Therefore, in general, an extremely thick photosensitive plate such as about 100 $\mu$in thickness is used so as to minimize the natural decay of the surface potential. In addition, a photodecomposable compound is always present in the photosensitive layer as an essential component is such system. and for example, when the photo-decomposable compound is carbon tetrabromide, there are problems of storing and toxicity as in photosensitive plates of a free radial type as mentioned above.

A conventional photosensitive plate having a photosensitive layer comprising a photo-decomposable material and a component capable of forming a sensitizing dye in addition to a photoconductive material can form a "sensitized pattern" in accordance with the original pattern by dye-sensitization based on the formation of a sensitizing dye at the photosensitive layer of solid state and radiation of short wave length having sufficient light energy. However, the photosensitive plate can not be repeatedly used (except for the purpose of double copying and use of an electrophotographic master) since the photo-decomposable compound is irreversibly charged. Further, the presence of photo-decomposable compound results in low storing property, low stability and thereby a narrower range of uses. Further, an excellent reproduced image is not always obtained.

These disadvantages are eliminated by this invention by which it is now possible to provide econimical, chemically stable and novel electrostatic photographic photosensitive materials.

The feature of a sensitizing treatment procedure according to this invention comprises applying a radiation energy to a free radical former giving free radicals when excited with a radiation energy. However, the main function of the radiation energy in this invention is not a simple conversion of an organic color forming component to a colored material, but resides in that an organic photoconductive material is modified by the photochemical reaction with a free radical former before applying a radiation energy and the organic photoconductive material thus modified is treated reactively with a dye base compound, or a photo-decomposed product formed from the free radical former, and/or the dye base compound chemically changed by the product formed secondarily from the photo-decomposed product. The product thus obtained can be used as a highly sensitive photosensitive material for electrophotography. Therefore, the effect of the sensitizing treatment according to this invention is completely different from the sensitization effect of simple addition of a sensitizing dye. The formation of a sensitizing dye by the sensitizing treatment is only one part of the effect of this invention.

One object of this invention is to provide a remarkably sensitized photosensitive composition for electrophotography a process for manufacturing such composition and an article of manufacture based on said composition.

Another object of this invention is to provide a highly sensitive organic photosensitive composition for electrophotography by applying radiation energy to an organic photoconductive material, a dye base compound and a free radical former producing free radicals when excited with a radiation energy, a process for the preparation thereof and an article of manufacture based on such composition.

A further object of this invention is to provide excellent and economical highly sensitive organic photoconductive photosensitive composition which can be produced by a simple sensitizing treatment without requiring any particular and complicated organic synthesis and purification processes, and a process for preparing said organic photoconductive photosensitive compositions.

A further object of this invention is to provide chemically stable and highly sensitive organic photosensitive materials a process for preparing said materials and an article of manufacture based on said composition.

A further object of this invention is to provide an organic photoconductive material for electrophotography suitable for color reproduction which photosensitivity and spectrum absorption characteristics are optionally controlled, a process for the preparation thereof and an article of manufacture based on said composition.

A further object of this invention is to provide an organic photoconductive composition having a desired color tone from an appearance and use point of view a process for the preparation thereof and an article of manufacture based on said composition.

A further object of this invention is to provide an organic photoconductive composition which surface potential is increased by appropriately selecting a dye base compound, a process for the preparation thereof and an article of manufacture based on said composition.

A further object of this invention is to provide a simple process for the preparation of the organic photoconductive material as mentioned in the above objects.

Other objects and advantages will be apparent from the following description and the appended claims.

This invention relates to a photosensitive composition for electrophotography which comprises mainly a free radical former capable of producing free radicals when excited with radiation energy, an organic photoconductive material and a dye base compound, and said compositions which are photochemically sensitized. This sensitizing treatment is effected by applying radiation energy sufficient to produce a free radical from the free radical former to modify the organic photoconductive material by the reactive action of a photo-decomposed product such as a free radical formed from the free radical former therewith and further by the reactive action of the free radical and/or a dye base compound chemically changed with a product formed secondarily from the free radical with the modified organic photoconductive material.

In the present invention, the "dye base compound" is a substance capable of forming a coloring matter as the result of reacting with a free radical former upon exposing to radiation energy in a sensitization treatment system.

Organic photoconductive materials employed in this invention may be selected from the wide range materials. The representative materials are, for example, as follows:

A.

Vinylcarbazoles (monomeric and polymeric):
vinylcarbazole, poly-9-vinylcarbazole, 9-vinylcarbazole
copolymer, nitrated poly-9-vinylcarbazole, poly-9-vinyl-3-aminocarbazole,
3-N-methylamino-9-vinylcarbazole
copolymer, halogenated vinylcarbazoles such as 3.6-dibromo-9-vinylcarbazole
copolymer, brominated poly-9-vinylcarbazole,
3-iodo-9-vinylcarbazole copolymer, and poly-3,6-diiodo-9-vinylcarbazole,
poly-3-benzylideneamino-9-vinylcarbazole,
poly-9-propenylcarbazole, graft copolymer of 9-vinylcarbazole
and ethyl acrylate (containing 90 mole % of 9-vinylcarbazole),
vinylanthracene-9-vinylcarbazole copolymer, 2- (or 3-) vinyl-9-alkyl-carbazole
(where alkyl is a primary alkyl such as
methyl, ethyl, propyl and the like) homopolymer or copolymer
and the like.

B.

Aromatic amino derivatives:
aminated polyphenyl, allylidene-azines, N,N'-dialkyl-N,N'-dibenzyl-phenylenediamine,
N,N,N', N'-tetrabenzyl-p'-phenylenediamine,
N,N'-diphenyl-p-phenylenediamine, N,N'-dinaphthyl-p-phenylenediamine.
4,4'-bis-dimethylaminobenzophenone,
and the like.

C.

Diphenylmethanes and triphenylmethanes:
diphenylmethane dye leuco base, triphenylmethane dye leuco base,
and the like.

D.

Compounds having a heterocyclic ring:
oxadiazole,
ethyl carbazole,
N-n-hexylcarbazole,
5-aminothiazole, 4,1,2-triazole,
imidazolone,
oxazole,
imidazole,
pyrazoline,
imidazolidine,
polyphenylenethiazole,
1.6-methoxyphenazine,
pyrazolinopyrazoline derivative,
α,ω-bis-(N-carbazole)-alkane derivative, and the like.

E.
Compounds having a condensed ring:
benzothiazole,
benzimidazole,
benzoxazoles such as 2-(4'-diaminophenyl)-benzoxazole.
2-(4'-dimethylaminophenyl)-benzoxazole and the like,
aminoacridine,
quinoxaline,
diphenylenehydrazones,
pyrrocoline derivative,
9,10-dihydroanthracene derivative,
and the like.

F.
Compounds having a double bond:
acylhydrazone,
ethylene derivative,
1,1,6,6-tetraphenylhexatriene,
1,1,5-triphenyl-pent-1-ene-4-yn-3-ol,
and the like.

G.
Condensed products:
condensed product of aldehyde and aromatic amine,
reaction product of secondary aromatic amine and aromatic halide,
poly-p-phenylene-1,3,4-oxadiazole,
and the like.

H.
Vinyl polymers (excluding polyvinylcarbazoles):
α-aklylacrylic amide polymer,
polyvinylacridine,
poly-[1,5-diphenyl-3-(4-vinylphenyl)-2-pyrazoline].
poly (1,5-diphenylpyrazoline),
polyacenaphthylene, nuclear substituted polyacenaphthylene,
polyvinylanthracene,
poly-2-vinyldibenzothiophene,
and the like.

I.
Organic photoconductive oligomers:
For example, the following oligomers may be mentioned.

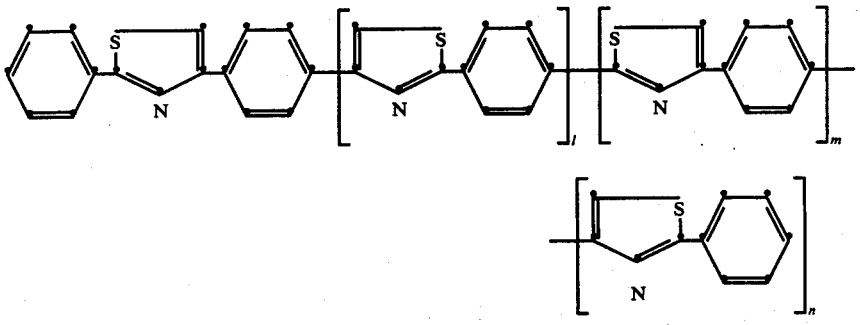

where $l$, $m$ and $n$ are 0 or 1 and satisfy the following relation $l \geqq m \geqq n$. Examples of the above oligomers are p-bis(2-phenyl-4-thiazolyl) benzene (5 ring compound), 2,4-bis- [4-(2-phenyl-4-thiazolyl)-phenyl] thiazole(7 ring compound), and 1,4-bis [4-{4-(2-phenyl-4-thiazolyl)-phenyl} thiazolyl] benzene (9 ring compound).

Among the above-mentioned organic photoconductive compounds, vinylcarbazoles and derivatives thereof, aromatic amino derivatives, diphenylmethane derivatives and triphenylmethane derivatives are particularly preferred in the present invention. Mixtures of organic photoconductive material may also be used such as one of the aforesaid vinylcarbazoles and one or more members selected from the group consisting of the aromatic amine derivatives, diphenylmethane type compounds and triphenylmethane type compounds. Additionally, such mixtures may also comprise two or more members selected from the group consisting of the aromatic amine derivatives, diphenylmetane type compounds and triphenylmethane type compounds.

The free radical formers used in this invention are compounds which give free radicals when excited by radiation energy. The free radical formers may be selected wide range compounds. The representative compounds are, for example, as follows:

A.
Polyhalogen compounds: $CBr_4$, $CI_4$, $CHI_3$, $C_2Cl_6$, $CBrCl_3$, $CCl_4$, $CHBr_3$, $CHCl_3$, $CHBr_3$, $C_2Br_6$, $C_2HBr_5$, $C_6H_5CBr_3$, $CIBr_3$, $CICl_3$, $CHICl_2$, $CHIBr_2$, $CBrCl_3$, $CHBrCl_2$, α, α, α-trichlorotoluene, α, α, α-tribromoacetophenone, 1,1,1-tribromo-2-methyl-2-propanol, 1,1,2,2-tetrabromoethane, 2,2,2-tribromoethanol, $CH_2Cl_2$, $CH_2Br_2$, $CH_2I_2$, $ClCH_2CH_2Cl$, $BrCH_2CH_2Br$, $CH_3CHCl_2$, $CH_3CHBr_2$, $CHCl_2CHCl_2$, $ClCH{=}CHCl$, $CHCl{=}CCl_2$, $Br(CH_2)_3Br$, $Br(CH_2)_4Br$, $Br(CH_2)_5Br$, $Br(CH_2)_6Br$; halogenated organic sulfoxides such as pentabromodimethylsulfoxide and hexabromodimethylsulfoxide; halogenated organic sulfones such as hexabromodimethy sulfone, trichloromethylphenyl sulfone, tribromomethylphenyl sulfone, trichloromethyl p-chlorophenyl sulfone, tribromomethyl p-nitro-phenyl sulfone, 2-trichloromethyl benzoxythiazolyl sulfone,
4,6-dimethyl-pyrimidyl 2-tribromomethyl sulfone,
tetrabromodimethyl sulfone, 2,4-dichlorophenyl trichloromethyl sulfone, 2-methy-4-chlorophenyl trichloromethyl sulfone, 2,5-dimethyl-4-chlorophenyl trichloromethyl sulfone, 2,4-dichlorophenyl tribromomethyl sulfone, bromomethyl dibromomethyl sulfone and the like.

B. Carbonyl compounds: vicinal polyketaldonyl compounds, α-carbonyl alcohols, acyloin ethers, α-hydrocarbo-substituted acyloins, polynuclear quinones and the like.

C. Organic sulfur compounds: alkyl disulfides, aralkyl disulfides, aryl disulfides, aroyl disulfides, acryl disulfides, cycloalkyl disulfides, mercaptans, thiols, metal mercaptides, dithiocarbamates, O-alkyl xanthene esters, thiuram derivatives, sulfenates and the like.

D. Peroxides: hydroperoxides, dialkyl peroxides, diacyl peroxides, diaroyl peroxides, and the like.

E. Azo and diazo compounds: azonitrile compounds, p-nitrobenzenediazonium-p-chlorobenzenesulfonate and the like.

Among the above-mentioned free radical formers, poly-halogen compounds are most preferred. Mixtures of free radical formers may also be used; such as, for example, at least one organic halogen compound and at least one member selected from the group consisting of the carbonyl compounds, organic sulfur compounds, peroxides, azo compounds, and diazo compounds, or, alternatively, said mixture may be at least one member selected from the group consisting of the carbonyl compounds, organic sulfur compounds, peroxides, azo compounds and diazo compounds.

The dye base compound in this invention is a compound that reacts with a free radical in a sensitizing treatment system by the action of radiation energy to form a coloring matter. This dye base compound may be selected from the following substances.

A. Leuco base or carbinol base

I. Leuco base or carbinol base of triphenylmethane dye

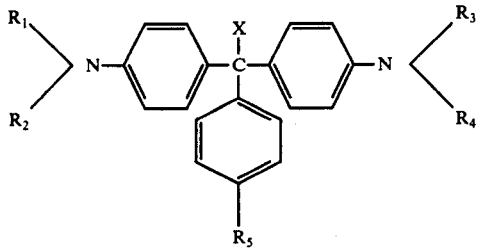

where $R_1$, $R_2$, $R_3$ and $R_4$ are, similar or dissimilar, selected from the group consisting of hydrogen, alkyl, aralkyl, and aryl (substituted or unsubstituted); $R_5$ is hydrogen or

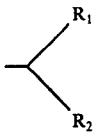

where $R_1$ and $R_2$ are as defined above; when X is —H, it is leuco base and when X is —OH, it is carbinol base.

Examples of the above-mentioned compound are leuco malachite green, leuco crystal violet, leuco methyl violet, leuco opal blue, carbinol malachite green, carbinol crystal violet, and carbinol methyl violet.

II. Leuco base or carbinol base of diphenylmethane dye:

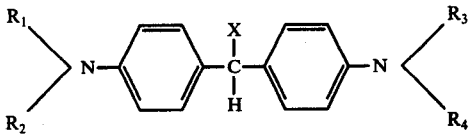

where $R_1$, $R_2$, $R_3$ and $R_4$ are, similar or dissimilar, selected from the group consisting of hydrogen, alkyl, aralkyl and aryl (substituted or unsubstited), when X is —H, it is leuco base and when X is —OH, it is carbinol base. An example of this compound is Michler's hydrol.

B. Styryl dye base:

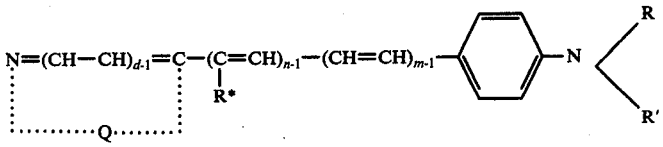

where R and R′ are, similar or dissimilar, selected from the group consisting of lower alkyl such as methyl, ethyl n-propyl and the like, and bensyl; R″ is a member selected from the group consisting of —H and —OH; *d* is an integer of 1 or 2; *n* is an integer of 1 or 2; *m* is an integer not larger than 3; the sum of $(n-1)$ and $(m-1)$ is not larger than 2; and Q represents the non-metallic atoms necessary to complete a heterocyclic nucleus having at least 5 and not more than 6 members in the rings.

Representative of the above-mentioned compound are 4-(4-dimethyl-aminophenyl-1, 3-butadienyl) quinoline, 4-p-dimethylaminostyrylquinoline, 2-p-dimethylaminostyrylquinolino, 2-(4-dimethylaminophenyl-1,3-butadienyl) quinoline, and 2-p-dimethylstyrylbenzothiazole.

C. Cyanine dye base

I.

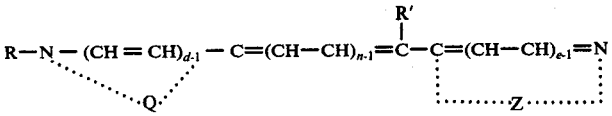

where *d* is an integer of 1 or 2; *e* is an integer of 1 or 2; *n* is an integer of 1 to 4; R is a member selected from the group consisting of alkyl, aralkyl and aryl; R′ is selected from the group consisting of hydrogen.

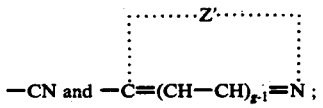

g is an integer of 1 or 2; Q, Z and Z' are non-metallic atoms (C, S, Se, O and N) necessary for forming a 5- or 6-membered heterocyclic ring.

Representative examples of the above-mentioned compound are 2-[3-(1-ethyl-2(1H)-quinolylidene) propenyl] quinoline, 2-[2-methyl-3-(3-ethyl-2(3H)-benzothiazolidene)-propenyl] benzothiazole, 4-[(1-ethyl-2(1H)-quinolylidene) methyl] quinoline, and 2-1-cyano-5-(ethyl-2(1H)-quinolylidene)-1,3-pentadienyl] quinoline.

II.

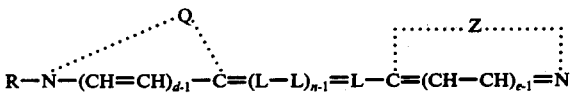

where *d, e, n,* R, Q and Z are as defined in (I) above; each L is, similar or dissimilar, selected from the group consisting of CH and N and at least one L should be N atom.

Representative examples of the above-mentioned compound are 4-[2-(3-ethyl-2(3H)-benzothiazolideneamino) vinyl] quinoline, 4-(1-ethyl-2(1H)-quinolylideneamino) quinoline, and (3-ethyl-2(3H)-benzothiazolidene)-(2-quinolylmethylidene)-hydrazine.

III.

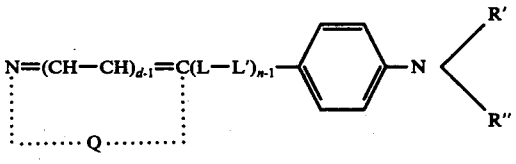

where R' and R'' are, similar or dissimilar, selected from the group consisting of alkyl and benzyl; *d* is 1 or 2; n is an integer of 1 to 4; L and L' are, similar or dissimilar, selected from the group consisting of

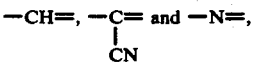

and at least one of L and L' is nitrogen atom; and Q is a nonmetallic atom necessary for forming a 5- or 6-membered ring.

Representative examples of the above-mentioned compound are 2-(p-dimethylaminobenzylidene) aminoquinoline, 2-[(3-p-dimethylaminophenyl)-2-propenylidene] -aminobenzothiazole, 4-(p-dimethylaminophenylimino)-cyanomethylquinoline, and 4-(p-dimethylaminophenylazo) quinoline.

D. Merocyamine dye base

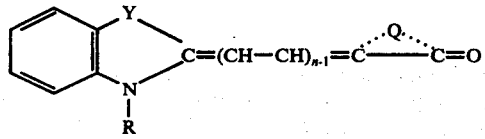

where R is a member selected from the group consisting of lower alkyl, aryl and aralkyl; Y is a non-metallic atom necessary for forming a 5- or 6-membered heterocyclic ring; n is an integer of 1 or 2; Q is a non-metallic atom necessary for forming a 5- or 6-membered heterocylic ring.

For example, Y is oxygen, sulfur or —$CH_2$—, and Q represents the non-metallic atoms necessary to complete a heterocyclic nucleus selected from the group consisting of N-ethylindole, phenyl isooxazolone and 3-ethylrhodanine.

Representative examples of the above-mentioned compound are 3-ethyl-5-[(3-ethyl-2-(3H)-benzoxazolidene] rhodanine, 1-ethyl-3-[(3-ethyl-2-(3H)-benzoxazolidene] oxyindole, 4-[(3-ethyl-2(3H)-benzoxazolidene) ethylindene] -3-phenyl-5-(4H)-isooxazolone, 3-ethyl-5-(3-ethyl-2-(3H)-benzothiazolidene) rhodanine, and 3-ethyl-5-(1-ethyl-2(1H)-quinolylidene) rhodanine.

E. Leuco dihydroanthracene compound:

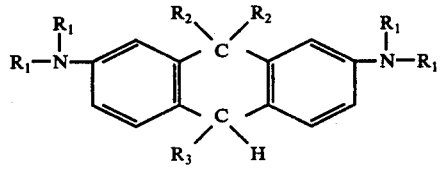

where each $R_1$ is, similar or dissimilar, selected from the group consisting of hydrogen, methyl, and ethyl; $R_2$ is, similar or dissimilar, selected from the group consisting of hydrogen and methyl; $R_3$ is selected from the group consisting of hydrogen, methyl, ethyl, and

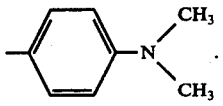

Preferable examples of the above-mentioned compound are 2,7-bis(dimethylamino)-10-p-dimethylaminophenyl-9,10-dihydro-9,9-dimethylanthracene, 2,7-bis(dimethylamino)-9,10-dihydro-9,9-dimethylanthracene, and 2,7-bis(dimethylamino)-10-ethyl-9,10-dihydro-9,9-dimethylanthracene. Mixtures of the dye base compound may also be used, such as, for example, at least one member selected from the group consisting of the leuco bases, carbinol bases, styryl dye bases, merocyanine dye bases, and leuco dihydroanthracene compounds. In the aforementioned mixture the leuco base can also be at least one member selected from the group consisting of the leuco base of the triphenylmethane dyes and the leuco base of the diphenylmethane dyes; whereas, the carbinol base may be at least one member selected from the group consisting of the carbinol base of the triphenylmethanes and a carbinol base of the diphenylmethane dyes.

The radiation energy source used in this invention is appropriately selected depending upon free radical formers, organic photoconductive materials, dye base compounds and solvents. Any radiation energy source may be used which can excite the free radical former to produce a free radical.

Light sources which can radiate a large amount of ultravilet rays or near ultraviolet rays, for example, a mercury lamp (low pressure, high pressure, or super-high pressure), metal halide lamp, and xenon lamp, are preferable. If desired, heat may be simultaneously applied under irradiation of ultraviolet rays to accelerate the decomposition of the free radical former. Further, the decomposition of the free radical former and the accompanying chemical reactions can be controlled by adjusting the time of the application of radiation energy. The temperature and the time of applying radiation energy are selected taking into consideration the degree of sensitization and undesirable side effects such as remarkable coloring and gelation.

Examples of effective wave length ranges of radiation energy are shown below:

| | |
|---|---|
| halogen compounds | 300 - 400 mμ |
| carbonyl compounds | 360 - 380 mμ |
| organic sulfur compounds | 280 - 400 mμ |
| peroxides | 300 - 400 mμ |
| azo compounds | 340 - 400 mμ |

Further, in detail, the effective wave length ranges of some of halogen compounds is shown below:

| | |
|---|---|
| $CBr_4$ | lower than 400 mμ |
| $CHBr_3$ and $CH_2Br_2$ | lower than 330 mμ |
| $CBrCl_3$ | lower than 400 mμ |
| $CHI_3$ | lower than 400 mμ |

According to this invention, the sensitization of organic photoconductive materials is, in principle, effected as follows. An organic photoconductive material, a dye base compound, and a free radical former are dissolved in an appropriate solvent to form a homogeneous solution and then subjected to the irradiation of radiation energy for the sensitization. In this case, the selection of solvent is important. The solvent should be that capable of dissolving sufficiently the organic photoconductive material, the dye base compound, and the free radical former and, in addition, should be effective in the sensitizing treatment. A solvent which reduces the sensitization effect should be avoided. Particularly, the selection of solvent largely depends upon the organic photoconductive material and the free radical former. With respect to, for example, a system where poly-N-vinylcarbazole and carbon tetrabromide are used as the organic photoconductive material and free radical former, it has been found that benzene and monochlorobenzene raise the sensitization effect while methylene chloride and chloroform reduce the sensitization effect. As is clear from such discovery, solvents play an important role in the sensitizing treatment according to this invention. Therefore, particularly, an appropriate solvent should be selected depending upon the combination of organic photoconductive material and free radical former.

The method of sensitizing treatment according to this invention is not restricted to the above-mentioned coexisting system method. There are further various methods such as, for example, a method which comprises applying a radiation energy to a solution of free radical former and then mixing the resulting solution with a solution containing organic photoconductive material and dye base compound (it is preferable to mix them as rapidly as possible); a method which comprises applying separately a radiation energy to a solution containing a free radical former and an organic photoconductive material and a solution containing a dye base compound and a free radical former and then mixing the two solutions; a method which comprises applying radiation energy to a solution containing an organic photoconductive material and a free radical former and then mixing the resulting solution with a solution containing a dye base compound; and a method which comprises applying a solution containing an organic photoconductive material, a free radical former and a dye base compound to a support and then applying a radiation energy.

With respect to the sensitizing treatment according to this invention, the mechanism of the sensitizing reaction as a fundamental method comprising applying a radiation energy to a system containing an organic photoconductive material, a free radical former and a dye base compound is considered as follows. However, this invention is not restricted by the following theoretical consideration.

A color forming recording method in which a free radical former and an organic color forming component are used, is disclosed, for example, in R. H. Spraugue etal: Phot. Sci. & Eng., Vol. 5, No. 2, p. 98 (1961). This method is called "Free radical printing-out system". On the basis of the free radical printing-out system this invention is interpreted as a process in which sim[illegible]e photosynthesis of a dye is effected by the reaction of a free radical former and an organic color forming component and the dye product thus photosynthesized works as an optical dye sensitizer to the organic photoconductive material. but such interpretation of this invention is not correct.

The technical contents of this invention is considered by taking a polyhalogen compound as the free radical former as an example as follows:

For example, a polyhalogen compound of the formula $R—CX_3$ where R is, for example is selected from hydrogen, halogen, carbonyl, nitro, amino, thioxy, alkyl or aryl (substituted or unsubstituted), X is, similar or dissimilar halogen such as chlorine, bromine, and iodine. When this polyhalogen compound is irradiated with a ufficient amount of radiation energy having a wave length of about 300 to 400 mμ, the reaction is considered to proceed as follows:

$$R—CX_3 \xrightarrow{h\nu} R—CX_2\cdot + X\cdot \quad (1)$$

The X· tus produced (halogen free radical) extracts hydrogen from the medium $$X\cdot \xrightarrow{H} HX \quad (2)$$

to form secondarily HX (halogen acid). Further, $R—CX_2\cdot$ (organic free radical) is considered as a chain carrier for causing the reactions (1) and (2) in a chain reacting manner.

The decomposed product of the organic polyhalogen formed photochemically according to the reactions of Formulas (1) and (2) above reacts chemically with an organic photoconductive material to form a modified organic photoconductive material different from the original organic photoconductive material which is not yet irradiated with a radiation energy, and behavior of the resulting modified organic photoconductive material is clearly different from that of the original organic photoconductive material. An important matter is that the present inventors have found that dye sensitization efficiency of the organic photoconductive material thus modified is markedly improved as compared with that of the original organic photoconductive material. It should be noted that the dye which may be photosynthesized from the free radical former and the dye base compound effectively affects the modified organic photoconductive material. It is considered that a component capable of working on the modified orgainc photoconductive material as a Lewis acid is formed by a reaction as shown in Formula (2) above and thereby the dye sensitization efficiency of the modified organic photoconductive material in coexistence with the Lewis acid is more enhanced. In connection with this, improvement of dye sensitization efficiency of inorganic photoconductive material coexistent with a Lewis acid has been known, for example, by Kokado, et al.: "Kagaku to Kogyo", Vol. 17, No. 12, page 1344 (1964). However, nothing has been known with respect to organic photoconductive material.

In view of the foregoing, the sensitization effect according to this invention is caused by the cooperation of an organic photoconductive material, a free radical former and a dye base compound.

The main effects of the invention are as follows.

Since the spectrum sensitivity range of the photosensitive matter of this invention usually ranges from 400 mμ to 750 mμ, the projection of an original pattern can be sufficiently carried out by visible light. Therefore, according to this invention, the photosensitive member is not subjected to a restriction of exposure conditions necessary as in the case where the peak of the spectrum sensitivity is at the short wave length region and ultraviolet or near ultraviolet ray would have to be used as a light source for exposure. Since the photosensitivity is extremely high, the copying can be effected within a short time.

The photosensitive matter according to this invention can be applied not only to usual electrophotographic processes, but also to processes where the photosensitive matter is repeatedly used to achieve stable and good reproduction.

The sensitizing treatment is, in principle, effected in the liquid phase, but it is not restricted to liquid phase. However, the sensitizing treatment in the liquid phase results in a remarkably sensitized photosensitive material. Additionally the photosensitive matter containing the photsensitive material does not contain a free radical former in the photosensitive layer so that the storing properties and the stability of the photsensitive matter are excellent. In addition, high electrostatic contrast can be retained even when the thickness of the photosensitive layer is only several μ to produce reproduced images of high contrast.

Furthermore, the sensitizing procedure according to this invention is a simple application of radiation energy, therefore, it is easy to sensitize a large amount of photosensitive material and as a result this sensitization process is valuable from commercial point of view. In addition, the photosensitive material thus sensitized can be handled in a similar way to photosensitive selenium or zinc oxide, and furthermore, the organic photoconductive material of this invention is naturally better than those inorganic photosensitive materials with respect of transparency, light weight and layer-shapability.

Sensitization treatment according to this invention is described in more detail in the following:

The amount of free radical former to be added in this invention is not critical, but it is preferable to select appropriately the amount depending on the kind of photoconductive material and the amount of radiation energy to be used. In general, 1 – 30% by weight on the basis of the amount of the photoconductive material is preferred. The amount of dye base compound to be added is not critical, but 0.5 – 10% by weight on the basis of the photoconductive material is preferred.

When the organic photoconductive material itself has film shapability, neither binder resins nor plasticizers are necessary. However, when it does not possess any film shapability, a binder resin is necessary. It is preferred to use a binder resin of 30 – 100% by weight of the amount of organic photoconductive material. A plasticizer may be added to improve the property of the film. Naturally, this addition of plasticizer is not essential. The amount of plasticizer to be added is preferably 5 – 100% by weight of the amount of the orgaic photoconductive material.

As the binder resin, various conventional resins may be used. Representative resins are, for example, a polystyrene resin, polyvinyl chloride, phenol resin, polyvinyl acetate resin, polyvinyl acetal resin, epoxy resin, xylene resin, alkyd resin, polycarbonate resin, and acrylonitrile-styrene resin.

As the plasticizer, various conventional plasticizer may be used. Representative plasticizer are, for example, dioctylphthalate, tricresylphosphate, diphenyl chloride, methyl naphthalene, p-terphenyl, and diphenyl.

It is also within the scope of this invention to use dye sensitizers or Lewis acids, singly or in combination, for the purpose of increasing the photosensitivity or adjusting spectrum sensitivity characteristics as usually used in conventional electrophotography.

According to the present invention, the highly sensitive electrostatic photosensitive plate is, in principle prepared as follows. A photosensitive solution containing an organic photoconductive material, a dye base compound and a free radical former and sensitized by radiation energy is applied to an appropriate transparent or opaque support to form a film. The film may be formed by roller coating, wire-bar coating, air knife coating or other usual coating methods. However, the process for preparing the electrostatic photosensitive plate is not limited to the above-mentioned methods. For example, there is used a prcess for preparing the photosensitive plate which comprises applying a solution containing an organic photoconductive material, a dye base compound and a free radical former to a support and then applying radiation energy to the resulting coating on the support, or a process which comprises continuously applying a solution containing an organic photoconductive material, a dye base compound and a free radical former to a support and then applying radiation energy to the resulting coating on the support, or a process which comprises continuously applying a solution containing an organic photoconductive material, a dye base compound and a free radical former to a support and simultaneously applying radiation energy and, if desired, followed by drying. These processes for the preparation of photosensitive member are simple and efficient from practical point of view.

Some embodiments of the production of the photosensitive member are shown below.

1. A process which comprises a step of applying a solution containing mainly an organic photoconductive material, a dye base compound and a free radical former to a support and a step of applying radiation energy to the coating to cause a remarkable sensitization;

2. A process which comprises a step of applying a solution as mentioned in item 1 above to a support, a step of applying radiation energy sufficient to cause a remarkable sensitization and a step of drying the resulting coating layer while accelerating the sensitizing effect;
3. A process which comprises a step of applying a solution as mentioned in item 1 above to a support and a step of applying contemporaneously light energy and heat energy causing and accelerating the sensitization;
4. A process which comprises a step of applying a solution as mentioned in item 1 above to a support, a step of applying contemporaneously light energy and heat energy causing and accelerating the sensitization, and a step of drying the resulting coating film while applying heat energy.

However, the process for the preparation of the photosensitive member according to this invention is not limited to those as described above.

For example, during the preparation, another layer such as an insulating layer may be laid over the photoconductive layer, or another layer may be inserted between the support and the photoconductive layer or between the photoconductive layer and the above-mentioned inslating layer, or a insulating layer may be place on a support. Furthermore, in a particular case, a self-supporting photosensitive member may be used without the support.

The thickness of the photoconductive layer on the support may be varied from several microns to several tens of microns depending upon each purpose. For usual uses, the thickness ranging from 10 $\mu$ to several microns are sufficient.

As the support, there may be used metal plates such as aluminum, copper, zinc, silver and the like, paper treated in such a manner that the solvent does not permeate, aluminium laminate paper, synthetic resin film in which a surfactant is incorporated, glass on which surface a metal, metal oxide, or metal halide is deposited, paper and synthetic resin film such as, for example, polyethylene, polypropylene, polyethylene terephthalate, polystyrene, polyvinyl chloride, ethylcellulose, celulose acetate and the like. In general, any support having a surface resistivity lower than that of the photoconductive layer may be used. A resistivity lower than $10^9\Omega$, more particularly lower than $10^5\Omega$, is preferable.

All conventional electrophotographic processes may be employed to form the electrophotographic image by using the photosensitive material sensitized by the present invention. One of the most familar conventional process is, for example, a Carlson process comprising, in combination, steps of charging, exposing, developing and fixing. For example, a positive charge is accumulated and reaches 150 -600 V by passing the photosensitive member several times through a corona discharger at + 6KV in a dark place. Then, light is projected to the photosensitive member through a positive pattern by using an appropriate light source such as a tungsten lamp and the electric charge at the exposed part is neutralized. The latent image thus formed is developed with a negatively charged toner by using a magnet brush developing method, a cascade developing method, or a fur brush developing method to form the corresponding positive image, which may be fixed by heating or by passing into an appropriate solvent vapor. A liquid developing method also can be used. The liquid developer usually comprises a colored toner and a carrier liquid, and, if desired, additives such as a controlling agent for improving the fixing property.

Further, the electric charge applied by corona charging may be a positive charge or a negative charge.

The following examples are presented to illustrate the methods of carrying out the present invention, but it is to be understood that they are given for the purpose of illustration and not limitation.

EXAMPLE 1

| | |
|---|---|
| poly-9-vinylcarbazole (Luvican M-170, trade name, supplied by BASF) | 8 g. |
| Carbon tetrabromide | 400 mg. |
| Leuco Malachite Green | 80 mg. |
| Benzene | 200 ml |

The solution containing the above-mentioned ingredients was irradiated with photochemical reactor (supplied by Ushio Denki Co. Ltd.) having a 100W. high pressure mercury lamp for 15 min. Then the resulting solution was uniformly applied onto a base paper of 70g./m$^2$, which was subjected to a solvent permeation preventing treatment (a coating of polyvinylalcohol of about 2g./m$^2$. ), by using a wire-rod resulting in a coating containing about 5g./m$^2$. of solid matter, followed by drying at about 60° C for 5 min. to produce a photosensitive paper. To the photosensitive paper thus obtained was applied a corona charging by using a charging device of about 5.5KV. to impart a uniformly negative charge of about 380V to the photosensitive paper followed by closely contacting a postive film original to the photosensitive paper and then exposing the photosensitive paper to a light from a 150W tungsten lamp at 80 lux. sec. The resulting photosensitive paper was soaked in a positive liquid developer to produce a sharp positive image of high fidelity to the original. When the above-mentioned solution was applied to the above-mentioned base paper and then irradiated by a 100W high pressure mercury lamp at a distance of 150 mm. for 27 sec. to produce a photosensitive paper, the resulting photosensitive paper was able to give positive image of high fidelity to the original under reproduction conditions simmilar to the above-mentioned procedure.

On the contrary, when a photosensitive paper obtained by applying a solution of only poly-9-vinylcarbazole was used, about 60,000 lux. sec. was necessary to obtain good positive images. With respect to commercially available zinc oxide type photosensitive paper sensitized with a coloring matter, about 95 lux. sec. was necessary.

| | |
|---|---|
| carbon tetrabromide | 400 mg. |
| Leuco malachite green | 80 mg. |
| and | |
| benzene | 200 ml |

Further, when a solution containing was irradiated with a photochemical reactor (supplied by Ushio Denki Co. Ltd.) having a 100W. high pressure mercury lamp for 10 min., and allowed to stand for a while, a blue-purple colored dye solution was obtained. In this dye solution was dissolved 8 g. of poly-9-vinylcarbazole (Luvican M-170, trade name) to produce a photosensitive liquid. This photosensitive liquid was applied to a base paper in a similar manner to the above-mentioned procedure. to form a photosensitive paper. This photosensitive paper was given a uniform negative charge of about 380 V. by applying a corona charge with a charging device of about 5.5 KV., intimately contacted with a positive film original, irradiated by a 150 W. tungsten lamp at 1,800 lux. sec., and immersed in a positive developer to form clear positive images of high fidelity to the original.

In view of the foregoing, it is understood that the sensitization of poly-N-vinylcarbazole by the dye produced photosynthetically from carbon tetrabromide and vinyl carbazole is one twentieth that obtained by a system containing poly-N--vinylcarbazole, carbon tetrabromide, vinylcarbazole, and benzene.

EXAMPLE 2

| | |
|---|---|
| Poly-9-vinylcarbazole (Luvican M-170, trade name supplied by BASF) | 4 g. |
| Acrylonitrile-styrene copolymer resin (Estylene AS-61NT, trade name supplied by Yahata Kagaku) | 4 g. |
| Carbon tetrabromide | 400 mg. |
| Leuco Cystal Violet | 50 mg. |
| Methylene chloride | 200 ml |

The solution containing ingredients as shown above was used to produce a photsensitive paper according to a procedure as in Example 1.

Corona charging was applied to the resulting photosensitive paper by using a charging device of about 5.5 KV to uniformly charge said paper to a negative charge of about 380 V. The photosensitive paper was then intimately contacted with a positive film original, irradiated with a 150 W. tungsten lamp at 160 lux. sec., and soaked in a positive liquid developer to produce clear positive images of high fidelity to the original.

EXAMPLE 3

| | |
|---|---|
| Poly-9-vinylcarbazole (Luvican M-170, trade name, supplied by BASF) | 8 g. |
| Carbon tetrabromide | 400 mg. |
| 2-(p-Dimethylaminostyryl)benzothiazole | 80 mg. |
| Benzene | 200 mg. |

The solution containing ingredients as shown above was irradiated in a similar manner to Example 1, and 5 ml. of benzene solution containing 80 mg. of 1,3,5-trinitrobenzene as a Lewis acid was added to the solution, which was then used for producing a photosensitive paper according to the procedure as in Example 1. Corona charging was applied to the photosensitive paper by using a charging device of about 5.5 KV to uniformly apply a negative charge of about 350 V. The photosensitive paper thus charged was intimately contacted with the positive film original, irradiated with a light source of a 150 W. tungsten lamp at 75 lux. sec., and soaked in a positive liquid developer to produce clear positive images of high fidelity to the original.

EXAMPLE 4

| | |
|---|---|
| Poly-9-vinylcarbazole (Polyvinylcarbazole PO-098, trade name, supplied by Schuchardt) | 8 g. |
| Carbon tetrabromide | 400 mg. |
| 2-(p-Dimethylaminostyryl)quinoline | 80 mg. |

-continued

| | |
|---|---|
| Benzene | 200 ml |

The solution containing the ingredients as above was irradiated according to the procedure in Example 1. A benzene solution (5 ml.) containing 20 mg. of Orient Oil Pink OP as a sensitizing coloring matter was added and then a photosensitive paper was produced by using the resulting solution according to the conditions as described in Example 1. Then, corona charging was applied to the photosensitive paper by using a charging device of about 5.5 KV. to uniformly apply a negative charge of about 370 V. The photosensitive paper was then intimately contacted with a positive film original, irradiated with a 150 W. tungsten lamp at 80 lux. sec. and soaked in a positive liquid developer to produce clear positive images of high fidelity to the original.

EXAMPLE 5

| | |
|---|---|
| Poly-3-bromo-9-vinylcarbazole | 8 g. |
| Carbon tetrabromide | 400 mg. |
| 2-[2-Methyl-3-(3-ethyl-2(3H)-benzothiazolidene)propenyl]benzothiazole | 60 mg. |
| Benzene | 200 mg. |

A solution containing the ingredients as above was irradiated in a similar manner as in Example 1.

To the resulting solution was added a benzene solution (50 ml) containing 4 g. of p-terphenyl and the solution thus obtained was uniformly applied to a polyester film of 75 $\mu$ thick onto which aluminum was sputtered by using a wire-bar. The coating amount was about 5g./m$^2$. (as solid matter). The resulting coating was dried at 70° C by using hot air blowing at a velocity of 10m./sec.to form a photosensitive film. Then, corona charging was applied to the photosensitive film by using a charging device of about 5.5 KV. to uniformly apply a negative charge of about 250 V. The photosensitive film was then intimately contacted with the positive film original, irradiated with a 150 W. tungsten lamp at 80 lux. sec., and soaked in a positive liquid developer to produce clear positive images of high fidelity to the original.

EXAMPLE 6

| | |
|---|---|
| Copolymer of 3-iodo-9-vinylcarbazole and 9-vinylcarbazole (Copolymerization molar ratio 40 : 60) | 8 g. |
| Iodoform | 400 mg. |
| 3-Ethyl-5-[3-ethyl-2(3H)-benzoxazolidene]rhodanine | 80 mg. |
| Benzene | 200 mg. |

A solution containing the ingredients as above was irradiated for 20 min. according to the conditions as used in Example 1. The solution thus irradiated was uniformly applied to a substrate to obtain a coating film of about 6g./m$^2$. (as solid matter) and then the coating was dried at 60° C for 15 min. to form a photosensitive plate. Corona charging was then applied to the photosensitive plate by using a charging device of about 5.5 KV. to uniformly apply a positive charge of about 280 V. The resutling photosensitive plate was intimately contacted with a positive film original, irradiated with a 150 W. tungsten lamp at 95 lux. sec., developed by a negatively charged toner with a magnet brush, and heated to fix. Thus, a clear postive image of high fidelity to the original was produced.

When a copolymer of 9-vinylcarbazole and styrene (copolymerization molar ratio 85 : 15) was used as an organic photoconductive material in place of the copolymer of 3-iodo-9-vinyl-carbazole and N-vinylcarbazole as mentioned above and irradiation was carried out in a similar manner to the above mentioned procedure to produce a photosensitive plate, the resulting photosensitive plate required an exposure of about 170 lux. sec. for obtaining positive images of high fidelity to the original.

EXAMPLE 7

| | |
|---|---|
| Poly-3-bromo-9-vinylcarbazole | 8 g. |
| Iodoform | 400 mg. |
| 2,7-Bis(dimethylamino)-10-p-dimethylaminophenyl-9,10-dihydro-9,9-dimethylanthracene | 100 mg. |
| Nitrobenzene | 200 ml |

A solution containing the above ingredients was irradiated for 20 min. according to the procedure as in Example 1. To the solution thus irradiated was added 5 ml of a methanol solution containing methyl violet (20 mg) as a sensitizing coloring matter, and the resulting solution was uniformly applied to a onesided art paper of about 80g./m$^2$ with a coating amount of about 5g./m$^2$. (as solid matter) by using a wire-bar and dried naturally to produce a photosensitive paper. The resulting photosensitive paper was given a uniform charge of about 300 V. by applying a corona charge using a charging device of about 5.5 KV., intimately contacted with a positive film original, irradiated by using a 150 W. tungsten lamp at 85 lux. sec., and soaked in a positive liquid developer to obtain clear images of high fidelity to the original.

When a copolymer of 9-vinylcarbazole and styrene (copolymerization molar ratio 70 : 30) was used as an organic photoconductive material in place of the above mentioned poly-3-bromo-9-vinylcarbazole and irradiated according to the procedure as mentioned above to form a photosensitive paper, the resulting photosensitive paper required an exposure of about 200 lux. sec. for obtaining positive images of high fidelity to the original.

EXAMPLE 8

| | |
|---|---|
| Graft copolymer of 9-vinylcarbazole and ethyl acrylate (copolymerization molar ratio 90 : 10) | 8 g. |
| Iodoform | 400 mg. |
| Leuco Methyl Violet | 80 mg. |
| Benzene | 200 ml |

A solution containing the above ingredients was irradiated for 15 min. according to the procedure in Example 1. To the solution was the added b 5 ml. of benzene containing 2 g. of diphenyl chloride as plasticizer and 50 mg. of 2,4,7-trinitro-9-fluorenone as a Lewis acid and the solution thus mixed was uniformly applied to an aluminum laminate paper 50 $\mu$ thick with a coating amount of about 5g./m$^2$. (as solid matter) by using a wire-rod and dried naturally to form a photosensitive paper. The resulting photosensitive paper was given a unifrom negative charge of about 320 V. by applying a corona charge with a charging device of about 5.5 KV., contacted with a positive film original, irradiated by using a 150 W. tungsten lamp at 70 lux.sec., and soaked in a positive liquid developer to form clear positive images of high fidelity to the original.

EXAMPLE 9

| | |
|---|---|
| Nitrated poly-9-vinylcarbazole (having 0.06 mole of nitro group mainly at the 3-position per mole of vinylcarbazole repeating unit) | 8 g. |
| Bromoform | 400 mg. |
| Carbinol Malachite Green | 80 mg. |
| Benzene | 200 ml. |

A solution having the above composition was irradiated for 20 min. in a similar manner to Example 1, applied in an amount of about 6g./m$^2$. (as solid matter) to a polyester film 75 $\mu$ thick having a sputtered aluminum coating thereon and then dried at about 60° C for 15 min. to form a photosensitive film. The resulting photosensitive film was given a uniform negative charge of about 350 V. by applying corona charging with a charging device of about 5.5 KV., intimately contacted with a positive film original, irradiated with a 150 W. tungsten lamp at 105 lux. sec., and developed by a fur-brush method with a positively charged toner to produce positive images of high fidelity to the original.

When a copolymer of 9-vinylcarbazole and ethyl methacrylate (copolymerization molar ratio 90 : 10) was emloyed as an organic photoconductive material in place of the above-mentioned poly-3-nitro-9-vinylcarbazole and irradiation was carried out in a similar manner to the above-mentioned procedure and a photosensitive film was prepared by using said irradiated copolymer according to the above-mentioned procedure, the resulting photosensitive film required an exposure amount of about 160 lux. sec. for obtaining positive images of high fidelity to the original.

EXAMPLE 10

| | |
|---|---|
| Poly-9-vinylcarbazole (Luvican M-170, trade name, supplied by BASF) | 8 g. |
| Tribromomethylsulfone | 400 mg. |
| 4-(p-Dimethylaminostyryl)quinoline | 80 mg. |
| Benzene | 200 ml. |

A solution having the above composition was irradiated by using a photochemical reactor having a 250 W. mercury lamp (supplied by Ushio Denki Co.) for 15 min. To the solution was then added 50 ml. of a benzene solution containing 2 g. of diphenyl chloride as plasticizer, and the solution thus obtained was uniformly applied in the amount of about 5g./m$^2$. (as solid matter) by using a wire-rod to a baryta paper having both surfaces treated, and dried at about 60° C for 20 min. to form a photosensitive paper. The resulting photosensitive paper was given a uniform negative charge of about 330 V. by applying a corona charge with a charging device of about 5.5 KV., contacted intimately with a positive film original, irradiated by using a 150 W. tungsten lamp at 85 lux. sec., and immersed in a positive liquid developer to obtain clear positive images of high fidelity to the original.

When poly-9-propenylcarbazole was used as an organic photoconductive material in place of poly-9-vinylcarbazole and subjected to similar irradiation treatment to form a photosensitive paper, an exposure of about 95 lux. sec. was required to obtain positive images of high fidelity to the original.

EXAMPLE 11

| | |
|---|---|
| 4,4'-Bis-dimethylaminobenzophenone | 4 g. |
| Polycarbonate resin ("Iupilon-E", trade name, supplied by Mitsubishi Edogawa Kagaku) | 4 g. |
| Carbon tetrabromide | 400 mg. |
| 2-[4-(p-Dimethylaminophenyl)-1,3-butadienyl] quinoline | 80 mg. |
| Methylene chloride | 200 ml. |

A solution having the above composition was irradiated for 15 min. in a similar manner to Example 1, uniformly applied in the amount of 5g./m². (as solid matter) to a base paper of 70g./m². subjected to a solvent permeation preventing treatment (polyvinylalcohol coating of about 2g./m².) by using a wire-rod, and dried at about 70° C for 20 min. to obtain a photosensitive paper. The resulting photosensitive paper was given a uniform negative charge of about 280 V. by applying a corona charge with a charging device of about 5.5 KV, intimately contacted with a positive film original, irradiated with a 150 W. tungsten lamp at 130 lux.sec., and immersed in a positive liquid developer to obtain clear positive images of high fidelity to the original.

EXAMPLE 12

| | |
|---|---|
| Bis-4,4'-diallylaminobenzylideneazine | 4 g. |
| Copolymer of acrylonitrile and styrene (Estylene AS-61NT, trade name, supplied by Yahata Kogaku) | 4 g. |
| Iodoform | 400 mg. |
| 4-[2-(3-ethyl-2(3H)-benzothiazolideneamino) vinyl]quinoline | 80 mg. |
| Methylene chloride | 200 ml. |

A solution having the above composition was irradiated for 20 min. according to the procedure as in Example 1. To the solution was then added 5 ml. of a methyl alcohol solution containing 20 mg. of Acridie Yellow as a sensitizing coloring matter and 70 mg. of chloranil as a Lewis acid, and the resulting solution was uniformly applied in the amount of about 6g./m². (as solid matter) to an Al plate 100 μ thick by using a wire-bar and dried at 70° C for 30 min. to form a photosensitive plate. The photosensitive plate thus produced was given a uniform negative charge of about 350 V. by applying a corona charge with a charging device of about 5.5 KV, intimately contacted with a positive film original, irradiated by a 150 W. tungsten lamp at 200 lux.sec., and immersed in a positive liquid developer to form clear positive images of high fidelity to the original.

EXAMPLE 13

| | |
|---|---|
| N,N,N', N'-tetrabenzyl p-phenylendiamine | 4 g. |
| Modified phenolic resin (Beckacite 1100, trade name, supplied by Japan Reichhold Chemical Inc.) | 4 g. |
| Bromoform | 400 mg. |
| 4-(p-Dimethylaminophenylazo)quinoline | 80 mg. |
| Benzene | 200 ml. |

A solution having the above composition was irradiated for 20 min. according to the procedure as in Example 1. The solution was then uniformly applied in the amount of 5g./m². to a polyester base film of 75 μ thick having sputtered aluminum thereon by using a wire-bar and dried with hot air of a speed of 15m./sec. at about 70° C to form a photosensitive film. The resulting photosensitive film was given a uniform negative charge of about 380 V. by applying a corona charge with a charging device of about 5.5 KV., intimately contacted with a positive film original, irradiated by a 150 W. tungsten lamp at 390 lux.sec. and then immersed in a positive liquid developer to form clear positive images of high fidelity to the original.

EXAMPLE 14

| | |
|---|---|
| Bis-4,4-diallylaminobenzylidene azine | 4 g. |
| Modified phenolic resin (Beckacite 1100, trade name, supplied by Japan Reichhold Chemical Inc.) | 4 g. |
| Tribromomethylphenyl sulfone | 400 mg. |
| 1-Ethyl-3-[(3-ethyl-2(3H)-benzoxazolidene]oxyindole | 80 mg. |
| Chlorobenzene | 200 ml. |

A solution having the above composition was irradiated for 15 min. by a photochemical reactor having a 250 W mercury lamp (supplied by Ushio Denki Co.). To the solution was then added 10 ml. of a chlorobenzene solution containing 80 mg. of tetrachlorophthalic anhydride as a Lewis acid, and the resulting solution was uniformly applied in the amount of 5g./m². (as solid matter) to a one sided art paper of about 80g./m². by a wire-bar and dried naturally for two days to form a photosensitive paper. The photosensitive paper thus obtained was given a uniform negative charge of about 350 V. by applying a corona charge with a charging device of about 5.5 KV., intimately contacted with a positive film original, irradiated by a 150 W tungsten lamp at 210 lux.sec., and immersed in a positive liquid developer to obtain positive images of high fidelity to the original.

EXAMPLE 15

| | |
|---|---|
| N,N,N',N'-tetrabenzyl-p-phenylenediamine | 4 g. |
| Polyvinylbutyral resin (S.lec BLS, trade name, supplied by Sekisui Kagaku) | 4 g. |
| Hexabromodimethylsulfoxide | 400 mg. |
| 3-Ethyl-5-[3-ethyl-2(3H)-benzothiazolidene]rhodanine | 60 mg. |
| Toluene | 200 ml. |

A solution having the above composition was irradiated 30 min. according to the procedure as in Example 14. The solution was then applied in the amount of 5g./m². (as solid matter) by a wire-bar to a 80 μ thick baryta paper, both sides of which were treated, and then the coating was dried at about 60° C for 30 min. to form a photosensitive paper.

The photosensitive paper was given a uniform negative charge of about 300 V. by applying corona charge with a charging device of about 5.5 KV., intimately contacted with a positive film original, irradiated by a 150 W. tungsten lamp at 360 lux.sec., and immersed in a positive liquid developer to obtain clear positive images of high fidelity to the original.

EXAMPLE 16

| | |
|---|---|
| Leuco malachite green | 4 g. |
| Polycarbonate resin (Panlite-C, trade name supplied by Teijin) | 4 g. |
| Carbon tetrabromide | 400 mg. |
| 2,7-Bis(dimethylamino)-9,10-dihydro-9,9-dimethylanthracene | 80 mg. |
| Methylene chloride | 200 ml. |

A solution having the above composition was irradiated for 20 min. according to a procedure as in Example 1.

The solution was then applied in the amount of 5g./m². (as solid matter) by a wire rod to a base paper (70 g./m².) coated with polyvinylalcohol in the amount of about 2g./m². for preventing penetration of solvent and dried at about 60° C for 20 min. to form a photosensitive paper.

The photosensitive paper was given a uniform negative charge of about 300 V. by applying a corona charge with a charging device of about 5.5 KV., intimately contacted with a positive film original, irradiated by a 150 W. tungsten lamp at 250 lux. sec. and developed with a positive developer to obtain clear positive images of high fidelity to the original.

EXAMPLE 17

| | |
|---|---|
| Leucomethyl violet | 4 g. |
| Modified phenol resin (Beckacite 1100, trade name, supplied by Japan Reichhold Chemical Inc.) | 4 g. |
| Iodoform | 400 mg. |
| 2,7-Bis(dimethylamino)-10-ethyl-9,10-dihydro-9,9-dimethylanthracene | 100 mg. |
| Benzene | 200 ml |

A solution having the above composition was irradiated for 30 min. according to a procedure as in Example 1. The solution was then applied to 80 μ thick one sided art paper in the amount of 5g./m². (as solid matter) by a wire-bar and dried at about 60° C for 30 min. to form a photosensitive paper. The photosensitive paper was given a uniform negative charge of about 280 V. by applying a corona charge with a charging device of about 5.5 KV., intimately contacted with a positive film original, irradiated by a 150 W. tungsten lamp at 290 lux.sec., and immersed in a positive liquid developer to obtain clear positive images of high fidelity to the original.

EXAMPLE 18

| | |
|---|---|
| Leuco crystal violet | 4 g. |
| Epoxy resin (Epikote 1004, trade name, supplied by Shell Oil Co., Ltd.) | 4 g. |
| Bromoform | 400 mg. |
| 4-[4-(p-Dimethylaminophenyl)-1,3-butadienyl]quinoline | 80 mg. |
| Benzene | 200 ml. |

A solution having the above composition was irradiated for 30 min. according to a procedure as in Example 1.

The solution was then applied in the amount of 5g./m². (as solid matter) by a wire-bar to a polyester base film of 75 μ thick, onto which aluminum was sputtered and dried at about 60° C for 30 min. to form a photosensitive film.

The photosensitive film was given a uniform negative charge of about 250 V. by applying a corona charge with a charging device of about 5.5 KV., intimately contacted with a positive film original, irradiated by a 150 W. tungsten lamp at 420 lux.sec., and immersed in a positive liquid developer to obtain clear positive images of high fidelity to the original.

EXAMPLE 19

| | |
|---|---|
| N,N'-tetramethyl-4,4'-diaminobenzhydrol | 4 g. |
| Acrylonitrile-styrene copolymer resin (Estylene AS-61NT, trade name, supplied by Yahata Kagaku) | 4 g. |
| Benzophenone | 400 mg. |
| 2-(p-Dimethylaminostyryl)benzothiazole | 150 mg. |
| Chloroform | 200 ml. |

A solution having the above composition was irradiated for 30 min. by a photochemical reactor having a 10 W low pressure mercury-vapour lamp (supplied by Ushio Denki Co.). To the solution was then added 10 ml. of a benzene solution containing 20 mg. of Orient Oil Pink OP as sensitizing coloring matter, and the resulting solution was uniformly applied in the amount of 5g./m². (as solid matter) by a wire-bar to a base paper of 70g./m²., which was coated with polyvinylalcohol in the amount of about 2g./m². for preventing penetration of solution, and dried at about 60° C for 20 min. to form a photosensitive paper. The photosensitive paper was given a uniform negative charge of about 350 V. by applying a corona charge with a charging device of about 5.5 KV., intimately contacted with a positive film original, irradiated by a 150 W. tungsten lamp at 430 lux.sec., and immersed in a positive liquid developer to obtain clear positive images of high fidelity to the original.

EXAMPLE 20

| | |
|---|---|
| Leuco malachite green | 4 g. |
| Polystylene resin (Piccolastic D-100, supplied by ESSO) | 4 g. |
| diphenylthiocarbazone | 400 mg. |
| Benzene | 100 ml. |
| Methylene chloride | 100 ml. |

A solution having the above composition was irradiated for 30 min. according to a procedure as in Example 1.

The solution was then applied to 100 μ thick aluminum plate in the amount of 6 g./m². (as solid matter) by a wire-bar and dried at about 60° C for 30 min. to form a photosensitive plate. The photosensitive plate was given a uniform negative charge of about 360 V. by applying a corona charge with a charging device of about 5.5 KV., intimately contacted with a positive film original, irradiated by a 150 W. tungsten lamp at 530 lux.sec., and immersed in a positive liquid developer to obtain clear positive images of high fidelity to the original.

EXAMPLE 21

| | |
|---|---|
| Leuco malachite green | 4 g. |
| Polycarbonate resin (Panlite-C, trade name, supplied by Teijin) | 4 g. |
| Di-t-butyl peroxide | 400 mg. |
| 2-[1-Cyano-5-(1-ethyl-2(1H)-quinolylidene)-1,3-pentadienyl]quinoline | 150 mg. |
| Methylene chloride | 200 ml. |

A solution having the above composition was irradiated for 20 min. by a photochemical reactor having a 500 W. xenon lamp (supplied by Ushio Denki Co.)

To the solution was then added 10 ml. of a methylene chloride solution containing 20 mg. of rhodamine as sensitizing coloring matter, and 80 mg. of 1,3,5-trinitrobenzene as a Lewis acid, and the resulting solution was uniformly applied to a 80 μ thick one sided art paper in the amount of 5g./m². (as solid matter) by a wire-bar, and dried at about 60° C for 30 min. to form a photosensitive paper. The photosensitive paper thus obtained was given a uniform negative charge of about 300 V. by applying a corona charge with a charging device of about 5.5 KV., intimately contacted with a positive film original, irradiated by a 150 W tungsten lamp at 450 lux. sec., and immersed in a positive liquid developer to obtain positive images of high fidelity to the original.

EXAMPLE 22

| | |
|---|---|
| Leuco crystal violet | 4 g. |
| Acrylonitrile-styrene copolymer resin (Estylene AS-61NT, trade name supplied by Yahata Kagaku) | 4 g. |
| 2-Azo-bis-isobutyronitrile | 400 mg. |
| 3-Ethyl-5-[3-ethyl-2(3H)-benzoxazolidene] rhodanine | 200 mg. |
| Methylene chloride | 200 ml. |

A solution having the above composition was irradiated for 20 min. according to a procedure as in Example 1. The solution was then applied to a 80 μ thick one sided art paper in the amount of 5g./m². (as solid matter) by a wire-bar. and dried at about 60° C for 20 min. to form a photosensitive paper. The photosensitive paper was given a uniform negative charge of about 290 V. by applying a corona charge with a charging device of about 5.5 KV., intimately contacted with a positive film original, irradiated by a 150 W. tungsten lamp at 510 lux.sec., and immersed in a positive liquid developer to obtain clear positive images of high fidelity to the original.

EXAMPLE 23

| | |
|---|---|
| Carbon tetrabromide | 100 mg. |
| Benzene | 25 ml |

A solution having the above composition in a 50 ml. quartz Erlenmyer flask was irradiated with a 500 W xenon lamp at a distance of 10 cm. for about 30 min. Then, a solution of poly-9-vinylcarbazole (PO-098, trade name, supplied by Schuchardt) 2 g. and carbinol crystal violet 20 mg. in 25 ml. of benzene was immediately mixed with the above-mentioned irradiated solution and the resulting mixture was allowed to stand in a dark place for 3 days, applied then to an Al plate of 0.8 mm. resulting in a coating thickness of about 5 μ, and dried naturally to form a photosensitive plate. The resulting photosensitive plate was given a uniform negative charge of about 350 V by applying corona charge with a charging device of about 5.5 KV, intimately contacted with a positve film original, irradiated with a 150 W. tungsten lamp at 95 lux.sec., and immersed in a positive liquid developer to form positive images of high fidelity to the original.

When a copolymer of 3-chloro-6-bromo-9-vinylcarbazole and 9-vinylcarbazole(copolymerization molar ratio 15:85) was used as an organic photoconductive material in place of poly-9-vinylcarbazole as mentioned above and subjected to the similar procedure to produce a photosensitive plate, about 125 lux. sec. was necessary to obtain postive images of high fidelity to the original.

EXAMPLE 24

| | | |
|---|---|---|
| I | Poly-9-vinyl carbazole | 2 g. |
| | Carbon tetrabromide | 50 mg. |
| | Benzene | 25 ml. |
| II | Iodoform | 50 mg. |
| | Leuco Methyl Violet | 20 mg. |
| | Benzene | 25 ml. |

Each of the solutions I and II was irradiated with a 100 W of high pressure mercury lamp for about 10 min. at a distance of 10 cm. Both solutions were immediately mixed and allowed to stand for about 10 hrs. in a dark room. The solution thus obtained was applied in a coating thickness of about 5 μ and dried naturally on a polyester film of 75 μ thickness, on which aluminum was sputtered to form a photosensitive film. The photosensitive film was given a uniform negative charge of about 360 V by applying corona charge with a charging device of about 5.5 KV., contacted with a positive film original, irradiated with a 150 W. tungsten lamp at 95 lux. sec., and immersed in a positive liquid developer to produce positive images of high fidelity to the original.

On the contrary, when a photosensitive film produced by using a single solution of poly-9-vinyl carbazole was employed, an exposure amount of about 58,000 lux.sec. was necessary to obtain good positive images as above.

When a copolymer of 3-bromo-6-iodocarbazole and 9-vinylcarbazole (molar ratio of 50:50) was used in place of the above-mentioned poly-9-vinylcarbazole as organic photoconductive materials and subjected to the similar procedure above to form a photosensitive film, an exposure of about 90 lux.sec. was necessary to obtain positive images of high fidelity to the original.

EXAMPLE 25

| | | |
|---|---|---|
| I | Poly-3-bromo-9-vinylcarbazole | 2 g. |
| | Bromoform | 50 mg. |
| | Chlorobenzene | 25 ml. |
| II | Ethane hexa chloride | 50 mg. |
| | Carbinol Crystal Violet | 20 mg. |
| | Benzene chloride | 25 ml. |

Each of the solutions I and II was irradiated with a 100W high pressure mercury lamp for about 15 min. at a distance of 10 cm. Both solutions were immediately mixed and allowed to stand for about 10 hrs. in dark room. To the solution thus obtained was added 10 ml. of a benzenechloride solution containing 0.5 g. p-terphenyl as plasticizer and the resulting solution was applied to a 50 μ thick aluminum laminated paper resulting in a coating thickness of about 5 μ and dried naturally to form a photosensitive paper. The photosensitive paper was given a uniform negative charge of about 350 V. by applying corona charge with a charging device of about 5.5 KV., contacted with a positive film original, irradiated with a 150 W. tungsten lamp at 125 lux.sec., and immersed in a positive liquid developer to produce positive images of high fidelity to the original.

EXAMPLE 26

| | | |
|---|---|---|
| I | Poly-9-vinylcarbazole (Lurican M-170, trade name, supplied by BASF) | 2 g. |
| | Hexa-bromo-dimethylsulfoxide | 50 mg. |
| | Benzene | 25 ml. |

-continued

| | | |
|---|---|---|
| II | Pentabromo-dimethyl-sulfoxide | 50 mg. |
| | 4-(p-Dimethylaminostyryl)quinoline | 20 mg. |
| | Benzene | 25 ml. |

Each of the solutions I and II was irradiated with an ultraviolet light source after which the solutions were immediately mixed and allowed to stand for about 24 hrs. under fluorescent light. To the solution thus obtained was added a 5 ml. benzene solution containing oil pink OP 5 mg. as sensitizing colour matter and the resulting solution was applied to a 80 μ thick baryta paper, which was treated to impart conductivity, resulting in a coating thickness of about 5 μ and dried naturally to form a photosensitive paper. The photosensitive paper was given a uniform negative charge of about 300 V. by applying corona charge with a charging device of about 5.5 KV., contacted with a positve film original, irradiated with a 150 W. tungsten lamp at 145 lux.sec., and immersed in a positive liquid developer to produce positive images of high fidelity to the original.

EXAMPLE 27

| | | |
|---|---|---|
| I | N,N,N',N'-tetrabenzyl-p-phenylenediamine | 1 g. |
| | Modified phenolic resin (Beckacite 1100, trade name, supplied by Japan Reichhold Chemical Inc.) | 1 g. |
| | Iodoform | 50 mg. |
| | Chlorobenzene | 25 ml. |
| II | Pentabromoethane | 50 mg. |
| | 4-[2-(3-Ethyl-2(3H)-benzothiazolideneamino) vinyl]quinoline | 20 mg. |
| | Chlorobenzene | 25 ml. |

Each of the solutions II and II was irradiated with a 100W. high pressure mercury lamp for about 20 min. at a distance of 10 cm. Both solutions were immediately mixed and allowed to stand for about 15 hrs. in dark room. The solution thus obtained was applied to a 80 μ thick one-sided art paper resulting in a coating thickness of about 5 μ and dried naturally to form a photosensitive paper. The photosensitive paper was given a uniform negative charge of about 250 V. by applying corona charge with a charging device of about 5.5 KV., contacted with a positive film original, irradiated with a 150 W. tungsten lamp at 280 lux.sec., and immersed in a positive liquid developer to produce positive images of high fidelity to the original.

EXAMPLE 28

| | | |
|---|---|---|
| I | N,N'-tetramethyl-4,4'-diaminobenzhydrol | 1 g. |
| | Tribromomethyl phenyl sulfone | 50 mg. |
| | Acrylonitrile-styrene copolymer resin (Estylene, trade name, supplied by Yahata Kagaku) | 1 g. |
| | Methylene chloride | 25 ml. |
| II | Hexabromodimethyl sulfone | 50 ml. |
| | 1-Ethyl-3-[3-ethyl-2(3H)-benzoxazolidene] oxyindole | 20 mg. |
| | Methylene chloride | 25 ml. |

Each of the solutions I and II was irradiated with a 500 W. xenon lamp for about 20 min. at a distance of 10 cm. Both solutions were immediately mixed and allowed to stand for about 24 hrs. under fluorescent light. The solution thus obtained was applied to a 100 μ thick aluminum plate resulting in a coating thickness of about 5 μ and dried by hot air to form a photosensitive plate. The photosensitive plate was given a uniform negative charge of about 5.5 V. by applying a corona charge with a charging device of about 250 KV., contacted with a positive film original, irradiated with a 150 W. tungsten lamp at 410 lux.sec., and immersed in a positive liquid developer to produce positive images of high fidelity to the original.

EXAMPLE 29

| | |
|---|---|
| Poly-9-vinylcarbazole (PO-098, trade name, supplied by Schuchardt) | 170 g. |
| Carbon tetrabromide | 10 g. |
| Leuco Crystal Violet | 2 g. |
| Diphenyl chloride | 30 g. |
| Benzene | 5 l. |

A solution having the above composition was applied in the amount of 6g./m². by the kiss roller coating method to a base paper of about 60g./m². (the surface was treated with a hydrophilic polymer for preventing permeation of solvent) and immediately after the applying, the resulting coating was irradiated with a high pressure mercury lamp (100 W.) at a distance of 15 cm. for 30 seconds. Then, the coated paper was dried at 70° C by hot air at a velocity of 15m./sec.

The resulting photosensitive paper was given a uniform negative charge of about 360 V. by applying a corona charge with a charging device of about 5.5 KV., contacted with a positive film original, irradiated with a 150 W. tungsten lamp at 105 lux.sec., and immersed in a positive liquid developer to form positive images of high fidelity to the original.

EXAMPLE 30

| | |
|---|---|
| Poly-3-bromo-9-vinylcarbazole | 200 g. |
| Indoform | 10 g. |
| 2-[4-(p-Dimethylaminophenyl)-1,3-butadienyl]quinoline | 2 g. |
| Toluene | 5 g. |

A solution having the above composition was applied to a base paper of about 73g./m². by reverse roller coating method (the surface being undercoated with a filler and synthetic resin emulsion) in the amount of 7g./m²., and immediately after the applying, the resulting coating was irradiated with a high pressure mercury lamp (100 W.) at a distance of 10 cm. for 25 seconds. Then, the coated surface thus obtained was kept at the distance of about 10 cm from a 200 W. infrared lamp for 20 sec. to dry the coating and thus photosensitive paper was obtained. The resulting photosensitive paper was given a uniform negative charge of about 370 V. by applying a corona charge with a charging device of about 5.5 KV., contacted with a positive film original, irradiated with a 150 W. tungston lamp at 120 lux.sec., and immersed in a positive liquid developer to form positive images of high fidelity to the original.

EXAMPLE 31

| | |
|---|---|
| Poly-9-vinylcarbazole (PO-098, trade name, supplied by Schuchardt) | 2 g. |
| Tribromomethyl phenyl sulfone | 100 mg. |
| 3-Ethyl-5-[(3-ethyl-2(3H)-benzothiazolidene]rhodanine | 20 mg. |
| Dioctyl phthalate | 0.5 g. |
| Chlorobenzene | 70 ml. |

A solution having the above composition was applied in the amount of 5g./m². a base paper of about 79g./m². (resistant to solvent penetration by means of a hydrophilic polymer) by a double roller coating method, and immediately after the the applying, the resulting coating was irradiated with a xenon lamp (500 W.) at a distance of 10 cm. for 15 seconds to form a photosensitive paper. The resulting photosensitive paper was given a uniform negative charge of about 280 V. by applying a corona charge with a charging device of about 5.5 KV., contacted with a positive film original, irradiated with a 150 W. tungsten lamp at 130 lux.sec., and immersed in a positive liquid developer to form positive images of high fidelity to the original.

EXAMPLE 32

| | |
|---|---|
| Leuco methyl violet | 1 g. |
| Modified phenolic resin (Beckacite 1100, trade name, supplied by Japan Reichhold Chemical Inc.) | 1 g. |
| Carbon tetrabromide | 100 mg. |
| 2,7-Bis(dimethylamino)-10-ethyl-9,10-dihydro-9,9-dimethylanthracene | 20 mg. |
| Chlorobenzene | 50 ml |

A solution having the above composition was applied to in the amount of 5g./m². to a base paper of about 79g./m². (undercoated with a hydrophilic polymer) by dip-roller coating method, and immediately after applying, the resulting coating was irradiated with a high pressure mercury lamp (100 W.) at a distance of 10 cm. for 25 seconds and simultaneously the coated paper was irradiated with a 200 watt infrared lamp and then dried at 70° C by a hot air stream at a speed of 10m./sec. The resulting photosensitive paper was given a uniform negative charge of about 290 V. by applying a corona charge with a charging device of about 5.5 KV., contacted with a positive film original, irradiated with a 150 W. tungsten lamp at 265 lux.sec., and immersed in a positive liquid developer to form positive images of high fidelity to the original.

EXAMPLE 33

| | |
|---|---|
| Poly-9-vinylcarbazole | 2 g. |
| Carbon tetrabromide | 100 mg. |
| Leuco Malachite Green | 20 mg. |
| Benzene | 50 ml. |

A solution having the above composition was applied to an about 800 μ thick baryta paper, which was treated so as to impart conductivity, resulting in a coating thickness of about 5 μ, irradiated with a 100 W. high pressure mercury lamp at a distance of 10 cm. for 10 min., and allowed to stand in a dark place for 12 hrs. after which the remaining carbon tetrabromide was removed by heating with infrared energy to form a photosensitive paper.

The resulting photosensitive paper was given a uniform negative charge of about 400 V. by applying a corona charge with a charging device of about 5.5 KV, intimately contacted with a positive film original, irradiated with a 150 W. tungsten lamp at 120 lux.sec., and immersed in a positive liquid developer to form positive images of high fidelity to the original.

When in this example carbon tetrachloride was used as the free radical former in place of carbon tetrabromide and the resulting coating was irradiated with a 500 W. mercury lamp at a distance of 10 cm. for 15 min., a similar result was obtained.

EXAMPLE 34

| | |
|---|---|
| Poly-9-vinylcarbazole | 2 g. |
| Carbon tetrachloride | 100 mg. |
| Leuco Crystal Violet | 20 mg. |
| Benzene | 50 ml |

A solution having the above composition was applied to an about 50 μ thick Al laminate paper resulting in a coating thickness of about 5 μ, then immediately irradiated with a 500 W. high pressure mercury lamp at a distance of 10 cm. for 15 min., allowed to stand in a dark place for 12 hrs., heated at 70° C to remove the remaining carbon tetrachloride to form a photosensitive paper.

The resulting photosensitive paper was given a uniform negative charge of about 370 V. by applying a corona charge with a charging device of about 5.5 KV., intimately contacted with a positive film original, irradiated with a 150 W. tungsten lamp at 115 lux.sec., and immersed in a positive liquid developer to form positive images of high fidelity to the original.

EXAMPLE 35

| | |
|---|---|
| Poly-9-vinylcarbazole | 2 g. |
| Bromotrichloromethane | 100 mg. |
| 2-(p-Dimethylaminostyryl)-quinoline | 20 mg. |
| Benzene | 50 ml |

A solution having the above composition was applied to an about 80 μ thick baryta paper, which was treated so as to impart conductivity, irradiated with a 500 W. high pressure mercury lamp at a distance of 10 cm. for about 8 min., allowed to stand in a dark place for 12 hours, and heated at 70° C to remove the remaining bromotrichloromethane to form a photosensitive paper of about 85 μ thickness.

The resulting photosensitive paper was given a uniform negative charge of about 370 V. by applying a corona charge with a charging device of about 5.5 KV., intimately contacted with a positive film original, irradiated with a 150 W. tungsten lamp at 110 lux.sec., and immersed in a positive liquid developer to form positive images of high fidelity to the original.

EXAMPLE 36

| | |
|---|---|
| 4,4-bis-Dimethylaminobenzophenone | 1 g. |
| Polycarbonate resin (Iupilon-E, trade name, supplied by Mitsubishi Edogawa Kagaku) | 1 g. |
| 2,5-Dimethyl-4-chlorophenyl trichloromethyl sulfone | 10 mg. |
| Carbinol Malachite Green | 20 mg. |
| Methylene chloride | 50 ml. |

A solution having the above composition was applied to a 80 μ thick one-sided art paper resulting in a coating thicknessof about 5 μ, irradiated with a 500 W. xenon lamp at a distance of 20 cm. for 30 min., and allowed to stand in a dark place for 2 days. The remaining 2,5-dimethyl-4-chlorophenyltrichloromethyl sulfone was removed by heating with infrared radiation and a photosensitive paper was formed.

The resulting photosensitive paper was given a uniform negative charge of about 300 V. by applying a corona charge with a charging device of about 5.5 KV, intimately contacted with a positive film original, irradiated with a 150 W. tungsten lamp at 150 lux.sec., and immersed in a positive liquid developer to form positive images of high fidelity to the original.

EXAMPLE 37

| | |
|---|---|
| 4,4'-Bis-dimethylamino-benzophenone | 2 g. |
| Leuco malachite green | 2 g. |
| Polycarbonate resin (Iupilon-E, trade name, supplied by Mitsubishi Edogawa Kagaku) | 4 g. |
| Carbon tetrabromide | 400 mg. |
| 2-(p-Dimethylaminostyryl)benzothiazole | 80 mg. |
| Methylene chloride | 200 ml |

A solution having the above composition was irradiated for 15 min. according to a procedure as in Example 1.

The resulting solution was uniformly applied by wire bar in the amount of 5g./m². (as solid matter) to a base paper (70 g./m².) (coated with polyvinylalcohol in the amount of 2g./m². for solvent resistance) and dried at about 70° C. for 20 min. to form a photosensitive paper. The photosensitive paper thus obtained was given a uniform negative charge of about 150 V. by applying a corona charge with a charging device of about 5.5 KV., intimately contacted with a positive film original, irradiated by a 150 W. tungsten lamp at 120 lux.sec., and immersed in a positive liquid developer to obtain positive images of high fidelity to the original.

EXAMPLE 38

| | |
|---|---|
| Carbon tetrabromide | 50 mg. |
| Tribromomethyl sulfone | 50 mg. |
| Benzene | 25 ml. |

A solution having the above composition was irradiated in a 50 ml. quartz Erlenmyer flask with a 500 W. xenon lamp at a distance of 10 cm. for about 15 min. Then, a solution having the following composition:

| | |
|---|---|
| Poly-9-vinylcarbazole (PO-098, trade name, supplied by Schuchardt) | 2 g. |
| 3-Ethyl-5-[3-ethyl-2(3H)-benzoxazolidene]rhodanine | 20 mg. |
| Benzene | 25 ml. |

was poured to the above-mentioned solution in the quartz Erlenmyer flask, and allowed to stand for 2 days in a dark place. Then, 10 ml. of a benzene solution containing 0.5 g. of diphenyl chloride as plasticizer was added thereto. The resulting solution was applied to a 50 μ thick aluminum laminated paper resulting in a coating thickness of about 5 μ, and dried naturally to form a photosensitive paper. The photosensitive paper thus obtained was given a uniform negative charge of about 300 V. by applying a corona charge by using a charging device of about 5.5 KV., intimately contacted with a positive film original, irradiated with a 150 W. tungsten lamp at 135 lux.sec., and immersed in a positive liquid developer to form positive images of high fidelity to the original.

EXAMPLE 39

| | |
|---|---|
| Poly-9-vinylcarbazole (PO-098, trade name, supplied by Schuchardt Co.) | 80 g. |
| Poly-3-bromo-3-vinylcarbazole | 100 g. |
| Iocoform | 10 g. |
| 2-[2-methyl-3-(3-ethyl-2(3H)-benzothiazolidene) propenyl]benzothiazole | 2 g. |

-continued

| | |
|---|---|
| Toluene | 5 2. |

A solution having the above composition was applied by reverse roller coating to a base paper of about 73g./m². (the surface being under coated with filler and a synthetic resin emulsion) in the amount of 6g./m²., and immediately after application, the resulting coating was irradiated with a high pressure mercury lamp (100 W.) at a distance of 10 cm. for 25 sec. Then, the coated surface was irradiated with a 250 W. infrared lamp at a distance of about 10 cm. for 20 seconds to dry the paper.

The resulting photosensitive paper was given a uniform negative charge of about 350 V. by applying a corona charge with a charging device of about 5.5 KV., contacted with a positive film original, irradiated with a 150 W. tungsten lamp at 115 lux.sec., and immersed in a positive liquid developer to form positive images of high fidelity to the original.

EXAMPLE 40

| | |
|---|---|
| Leuco malachite green | 4 g. |
| Poly carbonate resin (Panlite-C trade name, supplied by Teijin) | 4i g. |
| Bromoform | 200 mg. |
| 4-(p-Dimethylaminophenylazo)quinoline | 100 mg. |
| Ditertiarybutylperoxide | 200 mg. |
| Methylene chloride | 200 ml. |

A solution having the above composition was irradiated for 20 min. by a photochemical reactor having a 500 W. xenon lamp (supplied by Ushio Denki Co.). To the solution was then added 10 ml. of a methylene chloride solution containing, 20 mg. of Rhodamine as sensitizing coloring matter, and 80 mg. of 1,3,5-trinitrobenzene as a Lewis acid, and the resulting solution was uniformly applied to a 80 μ thick onesided art paper in the amount of 5g./m². (as solid matter) by a wire-bar, and dried at about 60° C. for 30 min. to form a photosensitive paper. The photosensitive paper thus obtained was given a uniform negative charge of about 320 V. by applying a corona charge with a charging device of about 5.5 KV., intimately contacted with a positive film original, irradiated by a 150 W tungsten lamp at 390 lux.sec., and immersed in a positive liquid developer to obtain positive images of high fidelity to the original.

EXAMPLE 41

| | | |
|---|---|---|
| I | Poly-3-bromo-9-vinylcarbazole | 1 g. |
| | N,N,N',N'-tetrabenzyl-p-phenylenediamine | 0.5 g. |
| | Modified phenolic resin Beckacite 1100, trade name, supplied by Japan Reichhold Chemical Inc.) | 0.5 g. |
| | Carbon tetrabromide | 50 mg. |
| | Chlorobenzene | 25 ml. |
| II | Pentabromoethane | 50 ml. |
| | 4-[4-(p-Dimethylaminophenyl)-1,3-butadienyl]quinoline | 10 mg. |
| | 4-(p-Dimethylaminophenylazo)quinoline | 10 mg. |
| | Chlorobenzene | 25 ml. |

Each of the solutions I and II was irradiated by a 100 W. high pressure mercury lamp at a distance of about 10 cm. for about 15 min. and then the two solutions were immediately mixed and allowed to stand under illumination of a fluorescent lamp for about 10 hours. The resulting mixture was applied to an aluminum laminate paper 50 μ thick resulting in a coating thickness of about 5 μ and dried by hot air to form a photosensitive paper. The photosensitive paper thus obtained was given a unform negative charge of about 310 V. by applying a corona charge with a device of about 5.5 KV, intimately contacted with a positive film original, irradiated with a 150 W. tungsten lamp at 145 lux.sec., and immersed in a positive liquid developer to form clear positive images of high fidelity to the original.

EXAMPLE 42

| | |
|---|---|
| Carbon tetrabromide | 50 mg. |
| Pentabromodimethyl sulfoxide | 50 mg. |
| Benzene | 25 ml. |

A solution having the above composition in a 50 ml. quartz Erlenmyer flask was irradiated with a 500 W. xenon lamp at a distance of 10 cm. for about 25 min. Then, a solution having the following composition:

| | |
|---|---|
| Poly-9-vinylcarbazole (Luvican M-170, trade name, supplied by BASF) | 1 g. |
| Poly-3-nitro-9-vinylcarbazole | 1 g. |
| Leuco Malachite Green | 20 mg. |
| Diphenyl chloride | 0.5 g. |
| Benzene | 30 ml. |

was poured to the above-mentioned solution in the quartz Erlenmyer flask, and allowed to stand for 3 days in a dark place. The resulting solution was applied to a 50 μ thick aluminum laminated paper resulting in a coating thickness of about 5 μ, and dried naturally to form a photosensitive paper. The photosensitive paper thus obtained was given a uniform negative charge of about 350 V. by applying a corona charge by using a charging device of about 5.5 KV., intimately contacted with a positive film original, irradiated with a 150 W. tungsten lamp at 105 lux.sec. and immersed in a positive liquid developer to form positive images of high fidelity to the original.

EXAMPLE 43

| | | |
|---|---|---|
| I | N,N'-tetramethyl-4,4'-diaminobenzhydrol | 0.5 g. |
| | Poly-9-vinylcarbazole | 0.5 g. |
| | Copolymer of acrylonitrile and styrene (Estylene AS-61NT, trade name, Yahata Kagaku) | 1 g. |
| | Carbon tetrabromide | 25 mg. |
| | Benzophenone | 25 mg. |
| | Chloroform | 25 ml. |
| II | Benzophenone | 25 mg. |
| | 2,7-bis(dimethylamino)-9,10-dihydro-9,9-dimethylanthracene | 20 mg. |
| | Chloroform | 25 ml. |

Each of the solutions I and Ii was irradiated by a 100 W. high pressure mercury lamp at a distance of about 10 cm. for about 10 min. and then the two solutions were immediately mixed and allowed to stand in a dark place for about 10 hours. The resulting mixture was applied in a coating thickness of about 5 μ to a polyester-film 75 μ thick having a sputtered aluminum coating thereon and dried naturally to form a photosenitive film. The photosensitive film thus obtained was given a uniform negative charge of about 380 V. by applying a corona charge with a charging device of about 5.5 KV, intimately contacted with a positive film original, irradiated with a 150 W. tungsten lamp at 140 lux.sec., and immersed in a positive liquid developer to form clear positive images of high fidelity to the original.

What is claimed is:

1. A process for producing a sensitized photosensitive material for electrophotography which comprises applying radiation to a solution of an organic photoconductive substance, a free radical former and a dye base said radiation being capable of generating free radicals from said free radical former.

2. A process according to claim 1 in which the amount of the free radical former is 1 - 30% by weight based on the organic photoconductive substance.

3. A process according to claim 1 in which the organic photoconductive substance is a member selected from the group consisting of vinylcarbazoles, aromatic amine derivatives, diphenylmethane type compounds, and triphenylmethane type compounds.

4. A process according to claim 1 in which the free radical former is a member selected from the group consisting of organic halogen compounds, carbonyl compounds, organic sulfur compounds, peroxides, azo compounds and diazo compounds.

5. A process according to claim 4 in which the organic halogen compound is a member selected from the group consisting of halogenated organic sulfone compounds, halogenated organic sulfides and a compound $R—CX_3$ wherein R represents a member selected from the group consisting of hydrogen, chlorine, bromine, iodine, alkyl, substituted alkyl, aryl, substituted aryl and aroyl, and each X represents a halogen atom selected from the group consisting of chlorine, bromine, and iodine, and may be the same or different from each other.

6. A process according to claim 1 in which the dye base is a member selected from the group consisting of leuco bases, carbinol bases, styryl dye bases, cyanine dye bases, merocyanine dye bases and leuco dihydroanthracene compounds.

7. A process for producing a sensitized photosensitive material for electrophotography which comprises applying a solution containing an organic photoconductive substance, a free radical former and a dye base to a support member and then, before the solution is dried, exposing the solution on the support member to a radiation energy capable of generating free radicals from said free radical former.

* * * * *

UNITED STATES PATENT AND TRADEMARK OFFICE

CERTIFICATE OF CORRECTION

PATENT NO. : 4,042,388

DATED : August 16, 1977

INVENTOR(S) : Eiichi Inoue; Ichiro Endo and Teruo Yamanouchi

It is certified that error appears in the above-identified patent and that said Letters Patent are hereby corrected as shown below:

At Col. 1, line 30, "strong light soruce" should read --strong light source--.

At Col. 2, line 41, "obtained:" should read --obtained;--.

At Col. 2, line 67, "material the free" should read --material of the free-.

At Col. 3, line 18, "dye give a difference" should read --dye gives a difference--.

At Col. 9, lines 25-26, "compound in this invention is a compound that reacts with a free radical in a sensitizing" should read --compound used in this invention is a compound that reacts with a free radical former in a sensitizing--.

At Col. 10, line 26, "or unsubstited)," should read --or unsubstituted),--.

At Col. 10, line 49, "Representative of the above-mentioned compound" should read --Representative examples of the above-mentioned compound--.

At Col. 11, lines 14-15, "2-1-cyano-5-(ethyl-2(1H)-quinolylidene)-1,3-pentadienyl]" should read --2-[1-cyano-5-(1-ethyl-2(1H)-quinolylidene)-1,3-pentadienyl]--.

UNITED STATES PATENT AND TRADEMARK OFFICE

CERTIFICATE OF CORRECTION

PATENT NO. : 4,042,388

DATED : August 16, 1977

INVENTOR(S) : Eiichi Inoue; Ichiro Endo and Teruo Yamanouchi

It is certified that error appears in the above-identified patent and that said Letters Patent are hereby corrected as shown below:

At Col. 12, delete lines 13-17 and substitute therefor the following --compound are 3-ethyl-5-[(3-ethyl-2(3H)-benzoxazolidene] rhodanine, 1-ethyl-3-[(3-ethyl-2(3H)-benzoxazolidene) ethylindene]-3-oxyindole, 4-[(3-ethyl-2(3H)-benzoxazolidene) ethylindene]-3-phenyl-5(4H)-isoxazolone, 3-ethyl-5-(3-ethyl-2(3H)-benzothiazolidene) rhodanine,--

At Col. 13, line 4, "ultravilet rays" should read --ultraviolet rays--.

At Col. 14, line 51, "The X tus produced" should read --The X thus produced--.

At Col. 16, line 19, "of the orgaic" should read --of the organic--.

At Col. 18, lines 56-60 should be deleted; at Col. 18, line 62, "Further, when a solution containing was irradiated" should read --Further, when a solution containing

| | |
|---|---|
| carbon tetrabromide | 400 mg. |
| Leuco malachite green | 80 mg. |
| and | 200 ml. |
| benzene | |

was irradiated--.

At Col. 19, line 25, "Leuco Cystal Violet 50 mg." should read --Leuco Crystal Violet 50 mg.--.

UNITED STATES PATENT AND TRADEMARK OFFICE

CERTIFICATE OF CORRECTION

PATENT NO. : 4,042,388

DATED : August 16, 1977

INVENTOR(S) : Eiichi Inoue; Ichiro Endo and Teruo Yamanouchi

It is certified that error appears in the above-identified patent and that said Letters Patent are hereby corrected as shown below:

At Col. 20, line 65, "The resutling" should read --The resulting--.

At Col. 21, line 57, "the added b 5 ml. of benzene" should read --then added 5 ml. of benzene--.

At Col. 21, line 65, "unifrom negative" should read --uniform negative--.

At Col. 21, line 67, "contacted with" should read --contacted intimately with--.

At Col. 23, line 38, "Acridie Yellow" should read --Acridine Yellow--.

At Col. 23, line 64, "of 5g./$m^2$. to a polyester" should read --5g./$m^2$. (as solid matter) to a polyester--.

At Col. 26, line 37, after the line "diphenylthiocarbazone 400 mg.", insert the line --2-(p-Dimethylaminostyryl)quinoline 150 mg.--.

At Col. 31, line 5, "after the the applying," should read --after applying,--.

At Col. 34, line 2, "Toluene 5 2." should read --Toluene 5 1.--.

UNITED STATES PATENT AND TRADEMARK OFFICE

CERTIFICATE OF CORRECTION

PATENT NO. : 4,042,388

DATED : August 16, 1977

INVENTOR(S) : Eiichi Inoue; Ichiro Endo and Teruo Yamanouchi

It is certified that error appears in the above-identified patent and that said Letters Patent are hereby corrected as shown below:

At Col. 34, line 26, "supplied by Teijin) 4i g." should read --supplied by Teijin) 4 g.--.

At Col. 36, line 4, "photosenitive film." should read --photosensitive film.--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*